US010472596B2

(12) United States Patent
Lang et al.

(10) Patent No.: US 10,472,596 B2
(45) Date of Patent: Nov. 12, 2019

(54) NON-PHOSPHOROUS TRANSITION METAL CONTROL IN LAUNDRY APPLICATIONS

(71) Applicant: Ecolab USA Inc., Saint Paul, MN (US)

(72) Inventors: Jason Lang, Saint Paul, MN (US); Jimmy Stokes, Saint Paul, MN (US); Carter M. Silvernail, Saint Paul, MN (US); David Dotzauer, Saint Paul, MN (US); Steven Lundberg, Saint Paul, MN (US); Krista Otting, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 16/019,735

(22) Filed: Jun. 27, 2018

(65) Prior Publication Data

US 2018/0371380 A1 Dec. 27, 2018

Related U.S. Application Data

(60) Provisional application No. 62/525,237, filed on Jun. 27, 2017.

(51) Int. Cl.

| | |
|---|---|
| ***C11D 3/33*** | (2006.01) |
| ***C11D 7/26*** | (2006.01) |
| ***C11D 11/00*** | (2006.01) |
| ***C11D 7/32*** | (2006.01) |

(52) U.S. Cl.

CPC ..... *C11D 7/265* (2013.01); *C11D 7/26* (2013.01); *C11D 7/3209* (2013.01); *C11D 7/3245* (2013.01); *C11D 11/0017* (2013.01)

(58) Field of Classification Search

CPC ..... C11D 3/33; C11D 11/0017; C11D 9/446; C11D 3/37

See application file for complete search history.

(56) References Cited

U.S. PATENT DOCUMENTS

| | | | | |
|---|---|---|---|---|
| 3,532,528 | A | 10/1970 | Carleton | |
| 3,803,042 | A | 4/1974 | Knox et al. | |
| 4,569,393 | A | 2/1986 | Bruning et al. | |
| 6,066,674 | A | 5/2000 | Hioki et al. | |
| 6,211,131 | B1 | 4/2001 | Kaaret et al. | |
| 6,602,837 | B1 | 8/2003 | Patel | |
| 7,665,227 | B2 | 2/2010 | Wright et al. | |
| 8,183,409 | B2 | 5/2012 | Christgau et al. | |
| 9,334,579 | B2 | 5/2016 | Crytzer et al. | |
| 9,376,650 | B2 | 6/2016 | Notte et al. | |
| 2003/0015219 | A1* | 1/2003 | Kravitz | C03C 23/0075 134/2 |
| 2008/0287334 | A1 | 11/2008 | Smith et al. | |
| 2010/0086626 | A1 | 4/2010 | Reilly | |
| 2010/0257676 | A1* | 10/2010 | Shamayeli | C11D 1/8255 8/137 |
| 2012/0208735 | A1* | 8/2012 | Byrne | C11D 3/044 510/241 |
| 2013/0111675 | A1 | 5/2013 | Soontravanich et al. | |
| 2013/0137618 | A1 | 5/2013 | Wood | |
| 2013/0261039 | A1 | 10/2013 | Little | |
| 2014/0106418 | A1 | 4/2014 | Parekh et al. | |
| 2014/0116472 | A1 | 5/2014 | Dahlquist et al. | |
| 2015/0094251 | A1 | 4/2015 | Rees et al. | |
| 2015/0299627 | A1* | 10/2015 | Soontravanich | D06L 1/16 8/137 |
| 2016/0002576 | A1 | 1/2016 | Jones et al. | |
| 2016/0130532 | A1 | 5/2016 | Moll et al. | |
| 2016/0222320 | A1 | 8/2016 | Foster et al. | |

FOREIGN PATENT DOCUMENTS

| | | | |
|---|---|---|---|
| CN | 100335427 | C | 11/1997 |
| CN | 101239272 | B | 7/2010 |
| CN | 102054994 | A | 5/2011 |
| CN | 102797162 | A | 11/2012 |
| CN | 103668233 | A | 3/2014 |
| CN | 104787758 | A | 7/2015 |
| CN | 104119544 | B | 5/2016 |
| CN | 105986499 | A | 10/2016 |
| CN | 106310240 | A | 1/2017 |
| GB | 1125942 | | 9/1968 |
| JP | 11181690 | A | 7/1999 |
| JP | 200220762 | A | 1/2002 |
| WO | 2005049679 | A2 | 6/2005 |
| WO | 2009033135 | A1 | 3/2009 |
| WO | 2012/028203 | A1 | 3/2012 |
| WO | 2012028203 | * | 3/2012 |
| WO | 2013077980 | A2 | 5/2013 |

(Continued)

OTHER PUBLICATIONS

Hufschmid, A., et al., "BOD5 Measurements of Water Presenting Inhibitory Cu2+ Implications in using of BOD to Evalute Biodegradability of Industrial Wastewaters", Chemosphere 50 (2003) pp. 171-176.

(Continued)

*Primary Examiner* — Charles I Boyer

(74) *Attorney, Agent, or Firm* — McKee, Voorhees & Sease, PLC

(57) ABSTRACT

Methods and compositions for improving laundry quality in multiple areas including detergency, bleaching and wastewater operations are provided by a laundry additive composition. The laundry additive composition and methods of using the composition control iron and other transition metals in water utilized within laundry applications.

16 Claims, 23 Drawing Sheets

(56) References Cited

FOREIGN PATENT DOCUMENTS

| | | |
|---|---|---|
| WO | 2014065852 A1 | 5/2014 |
| WO | 2017/083798 | 5/2017 |

OTHER PUBLICATIONS

Smolders, Eduard, et al., "Laundry Detergents, 1. Introduction", Ullmann's Encyclopedia of Industrial Chemistry, vol. 20, pp. 355-391. 2012.
Kramer, J. F., "Peracetic Acid: A New Biocide For Industrial Water Applications", Corrosion 97, Paper No. 404, pp. 1-16. 1997.
Jewell, Elaine Melody, "The Advancement of Oxygen Bleaching by using Chemical Additives to Improve Pulp Properties", UMI, pp. 1-191. Dec. 2002.
Regla, Higinio et al., "Use of Chelating Agents for Improving the Selectivity of Ozone Delignification on Soda Sugar Cane Bagasse Pulp", ISWPC, pp. 1-8. 1997.
Noel, D. et al., "Water Chemistry of Nuclear Reactor Systems 6", British Nuclear Energy Society, vol. 2, pp. 1-8. 1992.
Xi'an, P.R., "Proceeding of International Mechanical Pulping Conference 2011", China Light Press, pp. 1-5. 2011.
ECOLAB USA Inc., Application No. PCT/US2018/039721, filed Jun. 27, 2018, "The International Search Report and The Written Opinion of the International Searching Authority, or the Declaration" dated Sep. 6, 2018, 12 pages.

* cited by examiner

NON-PHOSPHOROUS TRANSITION METAL CONTROL IN LAUNDRY APPLICATIONS

CROSS-REFERENCE TO RELATED APPLICATIONS

This application claims priority under 35 U.S.C. § 119 to provisional application Ser. No. 62/525,237, filed Jun. 27, 2017, herein incorporated by reference in its entirety.

FIELD OF THE INVENTION

Embodiments disclosed relate to methods and compositions for improving laundry quality in multiple areas including detergency, bleaching and wastewater operations. In particular, methods and compositions for controlling transition metal contaminants in water utilized within laundry applications are provided. In an embodiment, non-phosphorous laundry additive compositions including chelants and a polymer beneficially control transition metals throughout the laundry process including but not limited to: break steps (initial alkaline detergent wash process), steaming or non-steaming, bleach and/or oxidizer steps, souring and laundry wastewater applications.

BACKGROUND OF THE INVENTION

In typical commercial or industrial laundry processes, textile materials such as sheets, towels, wipes, garments, tablecloths, etc. are commonly laundered at elevated temperatures with alkaline detergent materials. Such detergent materials typically contain a source of alkalinity such as an alkali metal hydroxide, alkali metal silicate, alkali metal carbonate or other such base component. When the linen is treated with an alkaline detergent composition a certain amount of carryover alkalinity may occur. Carryover alkalinity refers to the chemistry that is contained within the linen (that has not been completely removed) that is available for the next step. For example, when the detergent use solution provides an alkaline environment, it is expected that the detergent use solution will provide a certain amount of carryover alkalinity for a subsequent sour treatment step unless all of the detergent use solution is removed by rinsing. The residual components of the alkaline detergents remaining in or on the laundered item can result in fabric damage and skin irritation by the wearer of the washed fabric. This is particularly a problem with towels, sheets and garments. Sour materials contain acid components that neutralize alkaline residues on the fabric.

Another challenge in laundry processes are iron and other metals. Such contaminants may be present due to stains, such as rust, or present due to water utilized within the laundry process, such as transition metals resulting from inputted water sources and/or steam to heat a laundry process. Iron can enter the water at the source or be picked up from corroding (or lines in various states of corrosion) water lines and tanks. Iron may be present in water sources in a soluble colorless form called ferrous iron. When exposed to air, ferrous iron rapidly converts to insoluble ferric iron, which can vary in color from yellow to reddish brown. If not properly removed, iron and other metals can cause permanent yellowing of fabrics and loss of fabric life due to tensile strength loss. Metal content can further result in detergent inactivation and/or inhibition, accelerated loss of oxidizing chemistries used in a laundry process, shading due to deposition of metals, as well as shading due to optical brightener modification, and still other detrimental laundry effects.

To date the primary approach to removing metals from water sources utilized in laundry processes focus on water softening equipment to reduce iron impurities. In addition, the approach to remove metals from stains to date has primarily relied upon the use of high levels of caustic, which can damage delicate fabrics and, if not properly removed and brought back to neutral pH, can result in exposure of the caustic to human skin. Current laundry sour compositions to help remove residual alkali and for iron control generally include strong acids such as fluoroacetic acid, phosphoric acid, hydrofluoric acid, and hexafluorosilicic acid which are environmentally undesirable and/or hazardous.

As can be seen, there is a continuing need in the art for the development of iron and other metal control treatments after alkaline washing that not only prevent yellow staining of laundered fabrics, and remove residual caustic, but also that are environmentally friendly and sustainable. Moreover, formulations for laundry applications present distinct challenges in comparison to warewash or other hard surface cleaning applications where water conditioning and metal control may also be required. Laundry presents unique challenges of a greater surface area (relative to warewashing or hard surface) and requiring chelants to treat both hardness ions and transition metals (iron, copper, manganese).

Moreover, the use of surfactants and/or chelants that are common in warewashing applications do not readily provide same benefits in laundry applications. This is primarily a result of the differences between the substrates being treated, namely porous textiles in laundry present distinct challenges from hard surfaces treated in warewashing applications. For example, a towel, such as a terry towel, will absorb or have contaminants deposited on the substrate and can be difficult to remove; unlike warewash substrates which may have a deposit on a surface only in the form of a film which is easier to remove with detergent compositions. The adsorption of inorganic ions on fibers and soil in laundry applications can even modify the surface charge of the solids and as a result either compete with or enhance the adsorption of surfactants to the surface. This presents additional difficulties in treating laundry substrates in comparison to warewash hard surfaces. It is an object to provide laundry compositions and methods which provide iron and other metal control and prevention of yellowing that prevent yellowing at least as well as commercially available, less environmentally friendly sour treatment alternatives.

A further object is to provide a non-phosphorous laundry additive composition for the control of transition metals and beneficial laundry performance.

A further object is to provide methods and compositions for improving laundry quality in multiple areas including detergency, bleaching and wastewater operations.

Other objects, advantages and features of the present invention will become apparent from the following specification taken in conjunction with the accompanying drawings.

BRIEF SUMMARY OF THE INVENTION

An advantage of the methods and compositions disclosed according to embodiments is to control damaging effects of metals which may enter a laundry application from various sources, including for example water supplied to the washer, direct steam injection heated washers, and soil providing metal content.

In an embodiment, a method for treating laundry includes contacting the laundry with a laundry additive composition comprising a gluconate chelant, at least one additional chelant, a carboxylate polymer and water, wherein the laundry additive composition controls transition metal contaminants throughout the laundry process. In an aspect, the laundry process comprises an initial wash process utilizing transition metal contaminated water supplied to the washer. In an aspect, the laundry process comprises an initial wash process utilizing transition metal contaminated soils or laundry supplied to the washer. In an aspect, the laundry process comprises a steaming or direct steam injection contaminated with transition metals to heat waters utilized in the laundry process. In an aspect, the gluconate chelant is a gluconate salt, such as sodium gluconate. In an aspect, the at least one additional chelant comprises an aminocarboxylate or salt thereof. In an aspect, the aminocarboxylate comprises methyl glycine diacetic acid and/or diethylenetriaminepentaacetic acid. In an aspect, the carboxylate polymer is a polyacrylic acid or polymaleic acid. In an aspect, the dosing of the laundry additive conditioning composition is provided at a rate of: (a) about 0.5 fluid ounce to about 30 fluid ounces, (b) about 3 fluid ounces to about 30 fluid ounces per 100 pounds of linen, and/or (c) at a rate to control at least 0.1 ppm transition metals in the laundry process. In an aspect, the dosing of the laundry additive composition is provided at a rate of about 0.5 to about 5 grams/L of solution of the water conditioning composition, wherein the composition comprises from about 0.08 to about 0.8 grams/L gluconate salt chelant. In an aspect, the laundry additive composition is dosed into the washing machine, into a steam receiving side of a steam injection heated process within the laundry process, and/or into a water reuse or recycle storage container or output line.

In a still further aspect, the methods can include an initial step of measuring iron concentration in a water source or input to the laundry process. In a still further aspect, the contacting of the laundry additive composition is before or after a bleaching and/or oxidizing step in the laundry process. In a still further aspect, the contacting of the laundry additive composition is simultaneous with a bleaching and/or oxidizing step in the laundry process. In a still further aspect, the contacting of the laundry additive composition is before or after an alkaline detergent wash step in the laundry process. In a still further aspect, the contacting of the laundry additive composition is simultaneous with an alkaline detergent wash step in the laundry process. In a still further aspect, the contacting of the laundry additive composition is before or after a sour step in the laundry process. In a still further aspect, the contacting of the laundry additive composition is simultaneous with a sour step in the laundry process. In an additional embodiment, a laundry additive composition includes a gluconate salt chelants, at least one additional chelants including an aminocarboxylate, a carboxylate polymer, water. In an aspect, the composition is substantially phosphorous-free or phosphorous-free. In an aspect, the gluconate chelant is sodium gluconate or gluconic acid. In an aspect, the at least one additional chelant comprises an aminocarboxylate or salt thereof, such as a methyl glycine diacetic acid and/or diethylenetriaminepentaacetic acid. In an aspect, the carboxylate polymer is a polyacrylate polymer, a polyacrylic acid, a polymaleic acid, salt thereof or combination thereof. In an aspect, the gluconate salt chelants include from about 1 wt-% to about 30 wt-% of the composition, the at least one additional chelants comprises from about 0.1 wt-% to about 10 wt-% of the composition, the polymer comprises from about 1 wt-% to about 30 wt-% of the composition, and water comprises from about 20 wt-% to about 80 wt-% of the liquid composition. In an aspect, the ratio of the gluconate chelant to the carboxylate polymer is from about 1:1 to about 3:1 in the compositions. In an aspect, the compositions include at least one additional functional ingredient. In a still further aspect, the composition is free of surfactants.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
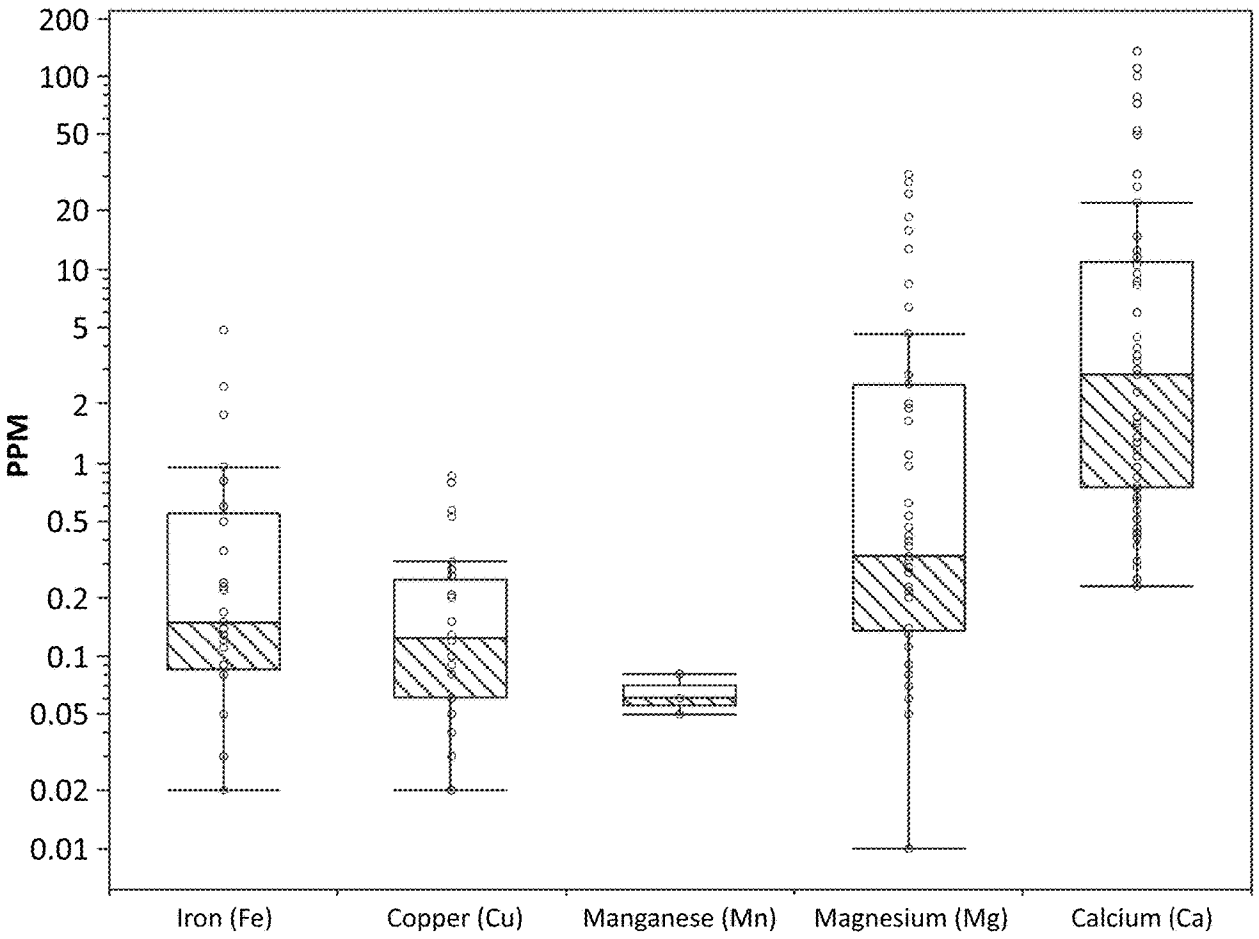
FIG. 1 shows the results of laundry process water sampled from customer accounts to demonstrate exemplary frequency of transition metal contamination measured by concentration (ppm), in addition to conventional hardness ions of magnesium and calcium, to demonstrate the need for transition metal control in laundry applications.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

Embodiments disclosed herein relate to methods and compositions for controlling the damaging effects of metals entering a laundry process from various sources, including for example water supplied to the washer, direct steam injection heated washers, and soil providing metal content. The methods and compositions have many advantages over conventional laundry applications, in that water containing metals, such as iron, copper and manganese, along with water hardness ions, can be addressed throughout all phases of the laundry process due to the formulation of the laundry additive compositions. Beneficially, the laundry additive compositions provide soil suspension and removal (such as on cotton fabrics), iron and other metal control, film prevention, protectant for off-coloring of fabrics and other formulation benefits allowing the composition to be used throughout the laundry process.

The embodiments are not limited to particular compositions and methods for laundering, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of the methods and compositions are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

An "antiredeposition agent" refers to a compound that helps keep suspended in water instead of redepositing onto the object being cleaned. Antiredeposition agents are useful in the present compositions and methods to assist in reducing redepositing of the removed soil onto the surface being cleaned.

As used herein, the term "cleaning" refers to a method used to facilitate or aid in soil removal, bleaching, microbial population reduction, rinsing, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

The terms "include" and "including" when used in reference to a list of materials refer to but are not limited to the materials so listed.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms.

The term "linen" refers to items or articles that are cleaned in a laundry washing machine. In general, linen refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of linen items including bed sheets, pillow cases, towels, table linen, table cloth, bar mops and uniforms.

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt-%, and most preferably, the amount of phosphate is less than 0.01 wt %. In an aspect, the laundry additive compositions are phosphate-free.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %. In an aspect, the laundry additive compositions are phosphorus-free.

The term "soft surface" refers to a resilient cleanable substrate, for example materials made from woven, nonwoven or knit textiles, leather, rubber or flexible plastics including fabrics (for example surgical garments, draperies, bed linens, bandages, etc.), carpet, transportation vehicle seating and interior components and the like.

As used herein, the term "soil" refers to polar or non-polar organic or inorganic substances including, but not limited to carbohydrates, proteins, fats, oils and the like. These substances may be present in their organic state or complexed to a metal to form an inorganic complex.

As used herein, the term "stain" refers to a polar or non-polar substance which may or may not contain particulate matter such as metal oxides, metal hydroxides, metal oxide-hydroxides, clays, sand, dust, natural matter, carbon black, graphite and the like As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "threshold agent" refers to a compound that inhibits crystallization of water hardness ions from solution, but that need not form a specific complex with the water hardness ion. Threshold agents include but are not limited to a polyacrylate, a polymethacrylate, an olefin/maleic copolymer, and the like.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, systems, and compositions may comprise, consist essentially of, or consist of the components and ingredients as well as other ingredients described herein. As used herein, "consisting essentially of" means that the methods, systems, and compositions may include additional steps, components or ingredients, but only if the additional steps, components or ingredients do not materially alter the basic and novel characteristics of the claimed methods, systems, and compositions.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and configured, constructed and arranged, adapted and configured, adapted, constructed, manufactured and arranged, and the like.

Methods of Use

The compositions and methods disclosed herein are suitable for improving laundry applications and performance. In particular, the compositions and methods disclosed herein are suitable for controlling transition metal contaminants to improve quality throughout the laundry process, including for example improved detergency, improved bleaching and wastewater operations. Without being limited to a particular mechanism of action, the use of the non-phosphorous laundry additive compositions controls the detrimental presence of transition metal contaminants in water sources employed throughout a laundry application.

The laundry additive compositions are suitable for use in conditioning water sources and soils contaminating a laundry process. Beneficially, the laundry additive compositions and methods of use thereof control transition metal contaminants throughout the laundry process. For example, transition metal contaminants can be introduced through multiple sources, which conventional detergents do not fully overcome. In an aspect, the laundry process includes an initial wash process utilizing transition metal contaminated water supplied to the washer. In a further aspect, the laundry process comprises an initial wash process utilizing transition metal contaminated soils or laundry supplied to the washer. In a still further aspect, the laundry process comprises a steaming or direct steam injection contaminated with transition metals to heat waters utilized in the laundry process. In a further aspect, a laundry process includes one or more of these steps which can detrimentally introduce metal contaminants into a laundry process.

The dosing of the laundry additive composition can be provided to one or more inputs of the laundry process. In an aspect, the laundry additive composition can be dosed into a washing machine in a wash cycle. In an aspect, the laundry additive composition can be dosed into a steam receiving side of a steam injection heated process within the laundry application. Beneficially, dosing to the water side of the steam injection, as opposed to the vapor or seam generating side, beneficially controls the transition metals in the water employed in the steam injection. In a further aspect, the laundry additive composition can be dosed into a water reuse or recycle storage container or output line (i.e. waste water). Beneficially, dosing to the reuse or recycle or waste water removes the contaminating transition metals before reusing and/or disposing of the water. The control of the transition metal contaminants in the waste water beneficially remove contaminants to reduce or eliminate the blockage or plugging of screens, filters and/or the like.

As one skilled in the art will ascertain based on the disclosure provided herein, the dosing rates of the laundry additive compositions can vary based upon the degree of contamination of the laundry process with transition metals. In an aspect, contamination can be measured by the presence of one or more of iron, copper and/or manganese. In further aspects, contamination can also be measured by the presence of one of more of alkaline earth metals, such as calcium and magnesium which are common contaminants in water hardness. In a further aspect, the contamination is preferably measured by the presence of iron. In a further aspect, the contamination can be measured by the presence of at least 0.1 ppm, at least 0.2 ppm, at least 1 ppm, or at least 10 ppm of iron or another transition metal contaminant or alkaline earth metal contaminant. Accordingly an initial step of the methods disclosed herein can comprise a measuring or detecting step, or a means for detecting, to determine contamination with any contaminants, namely transition metals and optionally alkaline earth metals.

In an aspect, the dosing of the laundry additive composition is provided at a rate of about 0.5 to about 30 fluid ounces per 100 pounds of linen, about 3 to about 30 fluid ounces per 100 pounds of linen, about 5 to about 30 fluid ounces per 100 pounds of linen, about 10 to about 30 fluid ounces per 100 pounds of linen, about 5 to about 25 fluid ounces per 100 pounds of linen, or about 5 to about 20 fluid ounces per 100 pounds of linen. In another aspect, the dosing of the laundry additive composition is provided at a rate to control transition metals contained at a concentration of at least about 0.1 ppm in a laundry process.

In an aspect, the dosing of the laundry additive composition is provided at a rate of about 0.1 to about 5 grams/L, or preferably about 0.5 to about 1 grams/L of solution of the laundry additive composition, wherein the composition comprises from about 0.08 to about 0.8 grams/L gluconate salt chelant.

In an aspect, the laundry additive composition control iron and other metals (including both transition metals and alkaline earth metals) across all stages or steps of the laundry process. Beneficially, the laundry additive compositions unexpectedly achieve the same stability (i.e. survivability or the ability of chelants to survive in the pH range while continuing to capture the transition metals) due to the combination of the gluconate chelants (particularly suitable for high pH), additional chelants, namely aminocarboxylates (particularly suitable for lower pH), and carboxylate polymers (particularly suitable for oxidizing conditions). In an aspect, the laundry additive composition beneficially controls the iron and other metal contaminants at a pH between about 5 to about 12, or preferably from about 6 to about 12 providing efficacy over acid, neutral and alkaline pHs.

In an aspect, the dosing of the laundry additive composition takes place before, simultaneously with, or after an initial alkaline detergent step (also referred to as a break step) in a laundry process. In a preferred embodiment, the dosing of the laundry additive composition takes place after the alkaline detergent step in a laundry process. In a preferred method, the dosing of the laundry additive composition takes place simultaneously with an alkaline detergent wash step in a laundry process.

In an aspect, the dosing of the laundry additive composition takes place before, simultaneously with, or after a bleaching (and/or oxidizing) step in a laundry process. In a preferred embodiment, the dosing of the laundry additive composition takes place before a bleaching (or oxidizing) step in a laundry process. As one skilled in the art will ascertain, treatment of a laundry bleach and/or oxidizing bath (including both chlorine based or oxygen based) is complex in that transition metals and turbidity need to be managed to optimize bleaching efficiency, presenting additional challenges.

In an aspect, the dosing of the laundry additive composition takes place before, simultaneously with, or after a sour step in a laundry process. In a preferred embodiment, the dosing of the laundry additive composition takes place before a sour step in a laundry process.

In an aspect, the dosing of the laundry additive composition takes place in a laundry system having a direct steam injection having increased contamination as a result of the heating system.

The methods of using the laundry additive compositions according to the embodiments provide additional benefits, including improved cleaning results on various linens and surfaces, and enhanced removal of stains.

Embodiments

Exemplary ranges of the laundry additive compositions are shown in Table 1 in weight percentage of a concentrate liquid composition. Laundry compositions are generally referred to as a liquid concentrates as they are further diluted upon dosing to a laundry application where additional water is present to dilute the concentrate composition.

TABLE 1

| Material | First Exemplary Range wt-% | Second Exemplary Range wt-% | Third Exemplary Range wt-% | Fourth Exemplary Range wt-% |
|---|---|---|---|---|
| Water | 20-80 | 40-80 | 45-70 | 50-65 |
| Gluconate salt chelant | 1-30 | 1-20 | 5-20 | 10-20 |
| Additional Chelants | 0.1-10 | 1-10 | 1-7 | 2-6 |
| Polymer | 1-30 | 1-20 | 5-20 | 10-20 |
| Additional Functional Ingredients | 0-25 | 0-20 | 0-10 | 0-5 |

The laundry additive compositions may include concentrate compositions or may be diluted to form use compositions. In general, a concentrate refers to a composition that is intended to be diluted with water to provide a use solution that contacts an object to provide the desired cleaning, rinsing, or the like. The laundry additive composition that contacts the water to be treated to control transition metal contaminants can be referred to as a concentrate or a use composition (or use solution) dependent upon the formulation employed in methods. A use solution may be prepared from the concentrate by diluting the concentrate with water at a dilution ratio that provides a use solution having desired laundry additive properties. The water that is used to dilute the concentrate to form the use composition can be referred to as water of dilution or a diluent, and can vary from one location to another. The typical dilution factor is between approximately 1 and approximately 10,000 but will depend on factors including concentration of transition metal contaminants and the like. In an embodiment, the concentrate is diluted at a ratio of between about 1:10 and about 1:10,000 concentrate to water. Particularly, the concentrate is diluted at a ratio of between about 1:10 and about 1:1,000 concentrate to water. More particularly, the concentrate is diluted at a ratio of between about 1:10 and about 1:100 concentrate to water.

Laundry Additive Compositions

The laundry additive compositions according to the present disclosure beneficially provide soil suspension and removal (such as on cotton fabrics and other laundry substrates), iron and other transition metal and alkaline earth metal control, film prevention, protectant for off-coloring of fabrics and other formulation benefits allowing the composition to be used throughout the laundry process. The laundry additive compositions are not detergent compositions as they do not contain surfactants. In an aspect, the laundry additive compositions comprise, consist of and/or consist essentially of a gluconate salt chelant, at least one additional chelant (preferably two additional chelants), a carboxylate polymer, and water.

Gluconate Salts

The laundry additive compositions include a gluconate salt chelant. In an exemplary embodiment, the gluconate salt chelant is sodium gluconate. Without being limited to a particular mechanism of action, sodium gluconate provides a benefit in having a greater affinity to the transition metals iron and copper, and moreover provides a 100% active compound for including in the laundry additive compositions. This further allows for the combined use of the sodium gluconate with additional chelants at a lower concentration due to the efficacy of sodium gluconate for treating the majority of the transition metal contaminant concentration. The additional chelants are selected as having preferred affinity for additional transition metal contaminants and/or traditional water hardness ions.

In an aspect, the compositions include from about 1 wt-% to about 30 wt-% gluconate salt chelants, from about 1 wt-% to about 20 wt-% gluconate salt chelant, from about 5 wt-% to about 20 wt-% gluconate salt chelant, or preferably from about 10 wt-% to about 20 wt-% gluconate salt chelant. In addition, without being limited according to the compositions, all ranges recited are inclusive of the numbers defining the range and include each integer within the defined range.

In an embodiment, the gluconate salt chelant is combined in the laundry additive composition with the at least one additional chelant in a ratio of at least about 1:1 or greater, including for example 1.5:1 or greater, 2:1 or greater, 2.5:1 or greater, or 3:1 or greater. The compositions containing a greater amount of the gluconate salt chelant relative to the additional chelant provides beneficial performance effects, including without limitation, as a result of the unexpected stability of the gluconate salt chelant (i.e. survivability or the ability of chelants to survive in the pH while continuing to capture the transition metals). Laundry additive compositions containing greater than 1:1 ratio with the additional chelant ensures the chelant package survives full pH range of the laundry methods, including pH between about 5 to about 12.

Additional Chelants

The laundry additive compositions include at least one additional chelant. Chelants include chelating agents (chelators), sequestering agents (sequestrants), builders, and the like. Examples of chelants include, but are not limited to, phosphonates, phosphates, aminocarboxylates and their derivatives, pyrophosphates, polyphosphates, ethylenediamene and ethylenetriamene derivatives, hydroxyacids, and mono-, di-, and tri-carboxylates and their corresponding acids. Other exemplary chelants include aluminosilicates, nitroloacetates and their derivatives, and mixtures thereof. Still other exemplary chelants include aminocarboxylates, including salts of methyl glycine diacetic acid (MGDA), ethylenediaminetetraacetic acid (EDTA) (including tetra sodium EDTA), hydroxyethylenediaminetetraacetic acid (HEDTA), and diethylenetriaminepentaacetic acid (DTPA). Chelants can be water soluble, and/or biodegradable. Other exemplary chelants include TKPP (tetrapotassium pyrophosphate), PAA (polyacrylic acid) and its salts, phosphonobutane carboxylic acid, Alanine,N,N-bis(carboxymethyl)-,trisodium salt, and sodium gluconate.

Additional suitable chelants include amino polycarboxylates, including but not limited to diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). Preferably the chelating agent is a biodegradable aminopolycarboxylate such as glutamic acid (GLDA), methylglycinediacetic acid (MGDA), L-aspartic acid N,N-diacetic acid tetrasodium salt (ASDA), DEG/HEIDA (sodium diethanolglycine/2-hydroxyethyliminodiacetic acid, disodium salt), iminodisuccinic acid and salts (IDS), and ethylenediaminedisuccinic acid and salts (EDDS).

In some embodiments, the additional one or more chelant(s) is substantially free of phosphorus. In more preferred embodiments, the additional one or more chelants is free of phosphorus. Preferably, the chelant is a sodium salt of aminocarboxylates. More preferably, the chelant is methyl glycine diacetic acid and/or diethylenetriaminepentaacetic acid.

In an aspect, the compositions include from about 0.1 wt-% to about 10 wt-% additional chelant, from about 1 wt-% to about 10 wt-% additional chelant, from about 1 wt-% to about 7 wt-% additional chelant, or preferably from about 2 wt-% to about 6 wt-% additional chelant. In addition, without being limited according to the compositions, all ranges recited are inclusive of the numbers defining the range and include each integer within the defined range.

Carboxylate Polymer

The laundry additive compositions include a carboxylate polymer. Carboxylate polymers which include polymers or copolymers of acrylic acid or maleic acid, and further includes substituted or functionalized analogs of the same.

In an aspect the carboxylate polymer is a polyacrylate polymer, including polyacrylic acid polymers, preferably low molecular weight acrylate polymers. Polyacrylic acid homopolymers can contain a polymerization unit derived from the monomer selected from the group consisting of acrylic acid, methacrylic acid, methyl acrylate, methyl methacrylate, ethyl acrylate, ethyl methacrylate, butyl acrylate, butyl methacrylate, iso-butyl acrylate, iso-butyl methacrylate, iso-octyl acrylate, iso-octyl methacrylate, cyclohexyl acrylate, cyclohexyl methacrylate, glycidyl acrylate, glycidyl methacrylate, hydroxyethyl acrylate, hydroxypropyl acrylate, 2-hydroxyethyl acrylate, 2-hydroxyethyl methacrylate, 2-hydroxypropyl acrylate, 2-hydroxypropyl methacrylate, and hydroxypropyl methacrylate and a mixture thereof, among which acrylic acid. methacrylic acid, methyl acrylate, methyl methacrylate, butyl acrylate, butyl methacrylate, iso-butyl acrylate, iso-butyl methacrylate, hydroxyethyl acrylate, 2-hydroxyethyl acrylate, 2-hydroxyethyl methacrylate, 2-hydroxypropyl acrylate, and 2-hydroxypropyl methacrylate, and a mixture thereof are preferred.

Preferred are polyacrylic acids, $(C_3H_4O_2)_n$ or 2-Propenoic acid homopolymers; Acrylic acid polymer; Poly(acrylic acid); Propenoic acid polymer, PAA have the following structural formula:

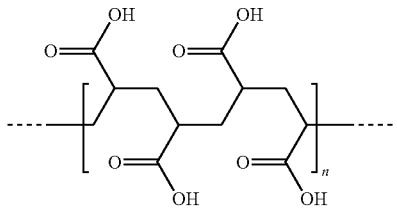

where n is any integer.

One source of commercially available polyacrylates (polyacrylic acid homopolymers) useful for the compositions includes the Acusol 445 series from The Dow Chemical Company, Wilmington Del., USA, including, for example, Acusol® 445 (acrylic acid polymer, 48% total solids) (4500 MW), Acusol® 445N (sodium acrylate homopolymer, 45% total solids)(4500MW), and Acusol®445ND (powdered sodium acrylate homopolymer, 93% total solids)(4500MW) Other polyacrylates (polyacrylic acid homopolymers) commercially available from Dow Chemical Company suitable for the compositions include, but are not limited to Acusol 929 (10,000 MW) and Acumer 1510. Yet another example of a commercially available polyacrylic acid is AQUATREAT AR-6 (100,000 MW) from AkzoNobel. Other suitable polyacrylates (polyacrylic acid homopolymers) for use in the compositions include, but are not limited to those obtained from additional suppliers such as Aldrich Chemicals, Milwaukee, Wis., and ACROS Organics and Fine Chemicals, Pittsburg, Pa. BASF Corporation and SNF Inc. Additional disclosure of polyacrylates suitable for use in the solid rinse aid compositions is disclosed in U.S. Application Ser. No. 62,043,572 which is herein incorporated by reference in its entirety.

Polymaleic acid $(C_4H_2O_3)x$ polymers or hydrolyzed polymaleic anhydride or cis-2-butenedioic acid homopolymer, has the structural formula:

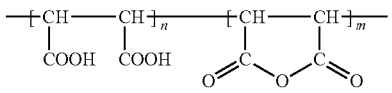

where n and m are any integer. Preferred polymaleic acid polymers which may be used for the compositions those with a molecular weight of about 400-800. Commercially available polymaleic acids include the Belclene 200 series of maleic acid homopolymers.

In an aspect, the compositions include from about 1 wt-% to about 30 wt-% carboxylate polymer, from about 1 wt-% to about 20 wt-% carboxylate polymer, from about 5 wt-% to about 20 wt-% carboxylate polymer, or preferably from about 10 wt-% to about 20 wt-% carboxylate polymer. In addition, without being limited according to the compositions, all ranges recited are inclusive of the numbers defining the range and include each integer within the defined range.

Water

The laundry additive compositions can be provided as liquid compositions containing water. The water source employed should be free of transition metals so as not to introduce any contaminants into the laundry process. In an aspect, the compositions include from about 20 wt-% to about 80 wt-% water, from about 40 wt-% to about 80 wt-% water, from about 45 wt-% to about 75 wt-% water, or preferably from about 50 wt-% to about 65 wt-% water. In addition, without being limited, all ranges recited are inclusive of the numbers defining the range and include each integer within the defined range. As one skilled in the art will ascertain the concentration of water in the laundry additive compositions can be adjusted to provide concentrate compositions and/or solid compositions.

Additional Optional Ingredients

The components of the laundry additive compositions can further be combined with various functional components suitable for use in laundry applications. In some embodiments, the laundry additive compositions including the gluconate chelants, additional chelants, polymer and water which make up a large amount, or even substantially all of the total weight of the composition. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used.

In preferred embodiments, the compositions do not include phosphonates. In other embodiments, the compositions may include anti-redeposition agents, bleaching agents, solubility modifiers, dispersants, metal protecting agents, stabilizing agents, corrosion inhibitors, fragrances and/or dyes, alkalinity sources, rheology modifiers or thickeners, hydrotropes or couplers, buffers, solvents and the like. In an aspect the compositions may include additional pH modifiers, including alkalinity agents, such as for example, hydroxides, carbonates, silicates, and the like.

Phosphonates

In some embodiments, the compositions of the present inventio include a phosphonate. Examples of phosphonates include, but are not limited to: phosphinosuccinic acid oligomer (PSO) described in U.S. Pat. Nos. 8,871,699 and 9,255,242; 2-phosphinobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2PO(ONa)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$(x=7); hexamethylenediamine(tetramethylenephosphonate), potassium salt, $C_{10}H_{(28-x)}N_2K_xO_{12}P_4$ (x=6); bis(hexamethylene)triamine (pentamethylenephosphonic acid). $(HO_2)POCH_2N[(CH_2)_2N[CH_2PO(OH)_2]_2]_2$; monoethanolamine phosphonate (MEAP); diglycolamine phosphonate (DGAP) and phosphorus acid, $H_3PO_3$. Preferred phosphonates are PBTC, HEDP, ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the composition is phosphorous-free.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Samples of water testing across various corporate textile care locations were collected. Water sampling tests for metals, including transition metals, were found in water employed in the wash cycles of a laundry process. The presence of any metal is documented. The results demonstrate that for transition metals, iron and copper are most prevalent and often present in relatively high amounts, including for example at least about 0.1 ppm, or at least about 0.5 ppm. Manganese tends to be less prevalent in municipal and well water. The sampling indicates the frequency of appearance of transition metals as Fe>Cu>Mn and the correspondence contaminant concentration (ppm) follows this pattern as well as shown in FIG. 1. Similarly, FIG. 1 shows the conventional hardness ions of magnesium and calcium that predominate in water sources conventionally employed in laundry applications. This testing permits formulations for use according to embodiments of the compositions and methods to combine use of chelants systems suitable for the handling of the transition metals having greater iron and copper in comparison to manganese, in addition to conventional water hardness ions.

Figure 2:
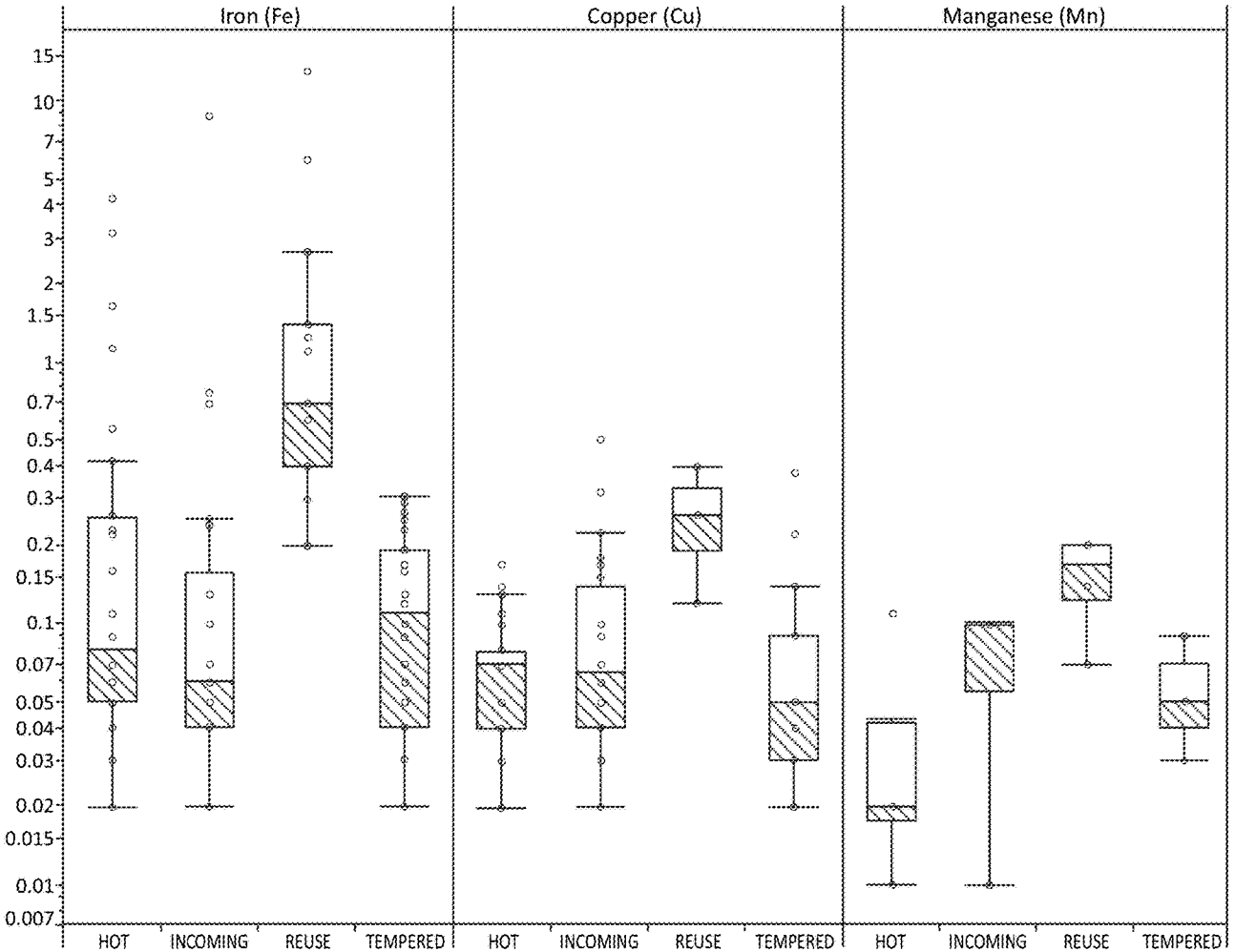
FIG. 2 shows the results of additional laundry process water sampled from multiple laundry sites at various points of the laundry process to demonstrate exemplary frequency of transition metal contamination measured by concentration (ppm) demonstrating the need for transition metal control in the entire laundry process due to variations in water quality depending upon location within the laundry process.

Additional sampling at multiple commercial laundry sites looking at various points of water sampling in the laundry process demonstrates the variation in transition metal contamination measured by concentration (ppm) throughout a laundry process. FIG. 2 demonstrates variation in iron, copper and manganese in hot water, incoming water to the washer, reuse water (such as a tunnel washer or capital intensive equipment to recapture/reuse water) and tempered water at the various sampled sites showing accumulation of the data points. As referred to herein, temperated water is warmed by way of a heat exchanger and the source is generally fresh cold water, warmed by heat exchanged from the effluent stream, and captured in a "tempered water tank" for use in the wash. These results are consistent with the broader sampling across multiple accounts shown in FIG. 1 in the appearance of transition metals as Fe>Cu>Mn and the corresponding contaminant concentration (ppm). In addition, the evaluated commercial laundry sites utilizes steam injected processes that would only increase the transition metal contamination seen in the reuse water depicted in FIG. 2. This testing further demonstrates the need for transition metal control in the entire laundry process due to variations in water quality depending upon location (or the source of process water) within the laundry process.

As a result of the testing confirming the contamination of transition metals in laundry processing waters, evaluations were conducted to evaluate the relative affinity of various chelants against the transition metals iron, copper and manganese, in addition to the water hardness ions of calcium and magnesium. The results indicate that gluconic acid, namely the sodium salt there of gluconate, demonstrates the greatest chelant affinity for the laundry metals of concern (Iron, Copper). However, the gluconate chelant does not provide sufficient affinity for the transition metal manganese and/or conventional water hardness ions. The results demonstrate the need for a multi-prong approach to water conditioning at the various wash process conditions (e.g. pH variations and the presence/absence of oxidizers), iron control and other metal control in laundry processes.

Example 2

Off-color (pink and yellow) staining of linens (or shading) were observed in a commercial laundry process. Samples of the linen were cut into pieces to test the linen under conventional laundering process with as many cycles as possible to recreate the off-coloring. Observations included effective soil removal and a lack of coloring seen in any 100% cotton linens. Water from the laundering process was also evaluated. Iron was detected in the break step (initial alkaline detergent wash step) drain of the laundering facility at levels above 0.5 ppm; however it was undetected in any subsequent steps. Based on the identification of iron present in steaming steps the presence of iron was evaluated in multiple laundering applications, including distinct locations using different linen samples in multiple washers for multiple formula classifications.

The iron was not detected in non-steaming wash step samples (i.e. bleach) or final wash step samples. The presence of iron in the steaming wash step versus lack of iron in a non-steaming wash step was submitted for analytical processing to determine the concentration levels of iron.

To confirm the detrimental impact of iron from a steaming step, the steaming step was removed from the laundering process and again iron was measured in the wash step samples. Only slight iron levels were detected. Thereafter, the steaming step was reintroduced to the laundry process and iron was again detected in the wash step sample. This testing confirms the need for water conditioning treatment, iron control and other metal control as applied to steaming applications entering a laundering process.

Example 3

Additional testing was conducted to visualize yellowing prevention according to embodiments utilizing laundry additive compositions. Yellowing prevention was evaluated from iron deposition when a known amount of contamination was applied to wash water. ICP-MS (inductively coupled plasma (ICP) mass spectrometry (MS)), a type of mass spectrometry capable of detecting metals and several non-metals at concentrations as low as one part in $10^{15}$ (part per quadrillion, ppq) on non-interfered low-background isotopes. The process ionizes a sample with inductively coupled plasma and then using a mass spectrometer to separate and quantify ions.

The novel compositions according to an embodiment were compared to existing products.

Control—no booster

Laundry additive Composition containing DTPA (aminopolycarboxylate chelant) 4 wt-%, Sodium Gluconate 15 wt-%, MGDA 1.7 wt-%, Polyacrylic and Polymaleic Acid polymers 16.2 wt-%, and water (remainder), overall contains greater amount and number of chelants in formulation compared to controls Positive Control 1—Commercially-available booster (MGDA 8.8 wt-% and Polyacrylic Acid 24 wt %)

Positive Control 2—Commercially-available booster (TKPP 39 wt % and Polyacrylic Acid 5 wt %)

The following conditions were employed: 5GPG water, Iron (2 ppm), 35 lb washer with 80% fill (100% spun polyester). Iron source: Ferrous Sulfate Heptahydrate. 15 Cycles were run with measurements every 5 cycles (Washer 12 with booster heater used. Two tested conditions alternated. First Control and Control 2. Then, Laundry additive Composition and Control 1). The complete cycle is shown in Table 2A with dosing rates of the chemistries shown in Table 2B.

TABLE 2A

| Wash Cycle |
|---|
| Wash: Iron (2 ppm), Alkaline detergents, Defoamer, Laundry additive composition* |
| Rinse |
| Rinse |
| Wash: Iron (2 ppm), Commercially-available Destainer |
| Rinse |
| Rinse |
| Wash: Commercially-available liquid deodorant |
| Wash: Commercially-available concentrated laundry liquid sour |

*Experimental Sets Only

TABLE 2B

| Chemistry | Oz/cwt |
|---|---|
| Alkaline detergent (E-Max Alkali) | 6 |
| Alkaline detergent (Luminate Detergent) | 3 |
| Positive Control 2 (Liquid Bonus) | 2.64 |
| Positive Control 1 (Luminate Booster) | 3.9 |
| Laundry Additive Composition | 3 |
| Defoamer | 0.09 g |
| Commercially-available Bleach Destainer (Laundri Destainer) | 12 |
| Commercially-available liquid deodorant (Bannish II) | 1 |
| Commercially-available concentrated laundry liquid sour (Sour VII) | 1 |

Figure 3:
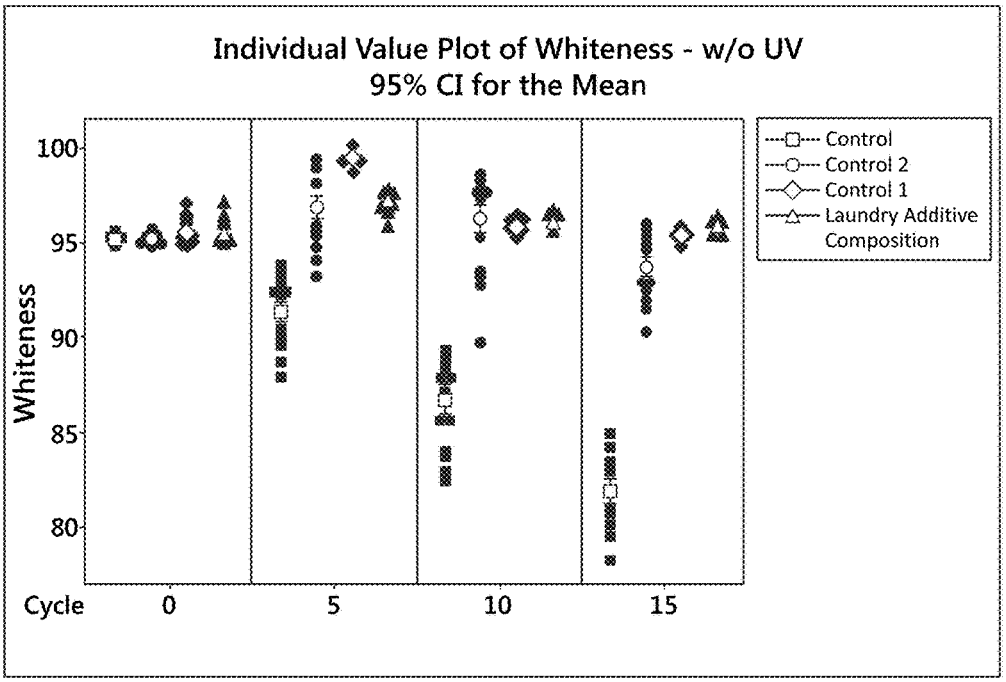
FIG. 3 shows comparative whiteness evaluations of an embodiment of the laundry additive composition compared to negative and positive controls.
Figure 4:
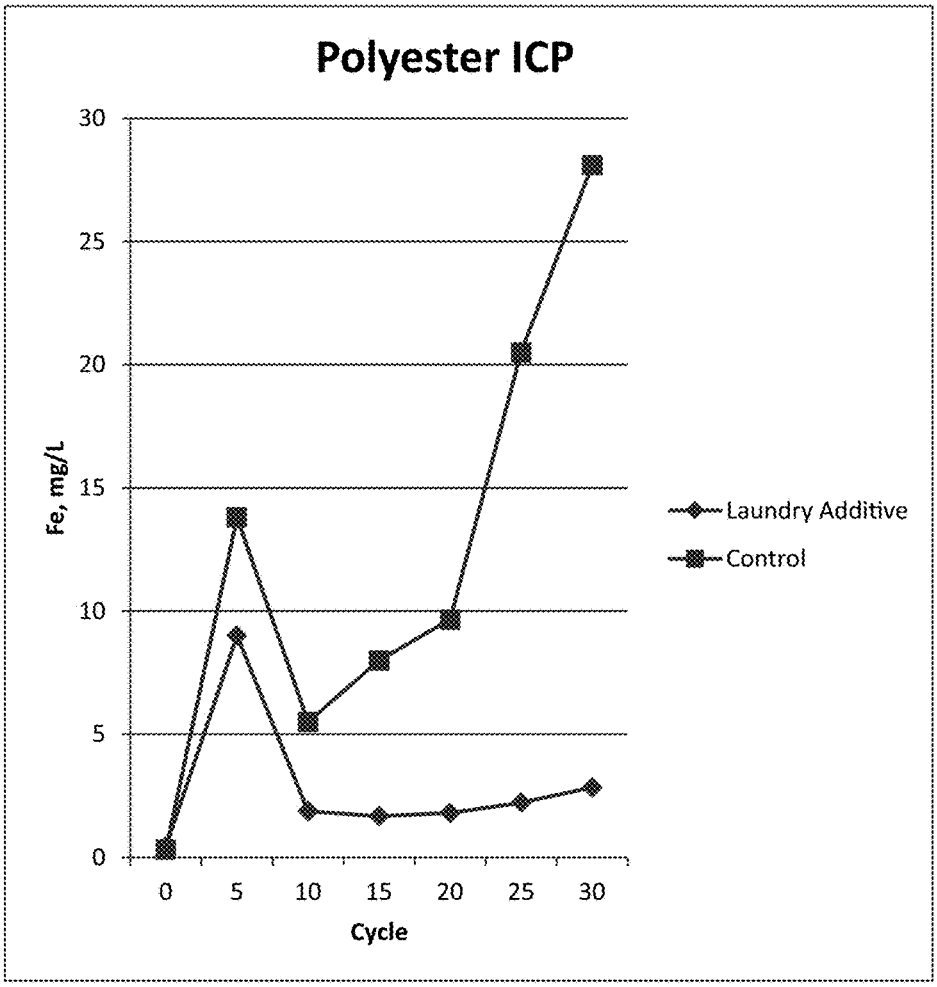
FIG. 4 shows the amount of iron (metal deposition) on polyester swatches measured in an evaluation according to an embodiment.
Figure 5:
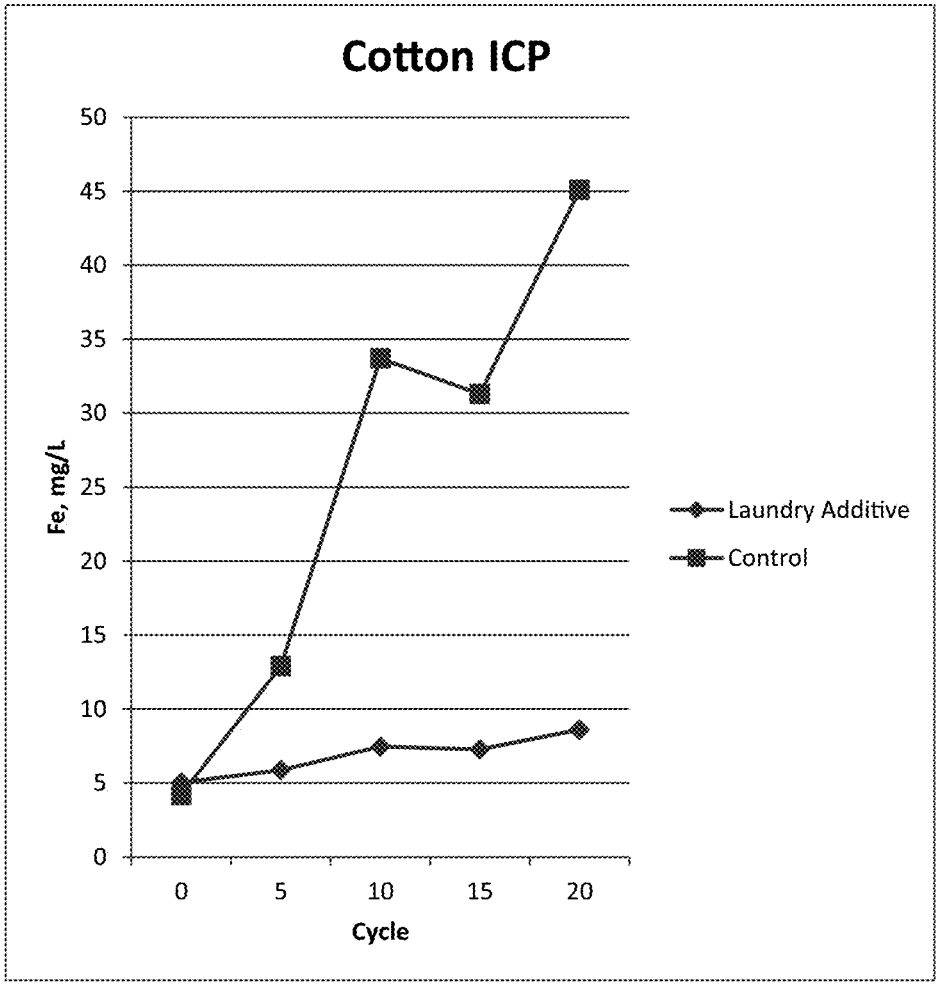
FIG. 5 shows the amount of iron (metal deposition) on cotton swatches measured in an evaluation according to an embodiment.

The results are shown in FIG. 3 depicting whiteness of the fabrics (without using UV). Individual standard deviations were used to calculate the intervals. The measurement of whiteness shown over increasing number of cycles beneficially remains above 95 for the Laundry Additive Composition. The whiteness measurements are shown as CIE standard illuminate D65 without UV, wherein a change in increment of 5 or greater is visually detectable by the average user on the whiteness scale. The actual amount of metal deposition on the fabric swatches was measured as shown in FIGS. 4-5. FIG. 4 shows the amount of iron on polyester swatches. FIG. 5 shows the amount of iron on cotton swatches.

Figure 6:
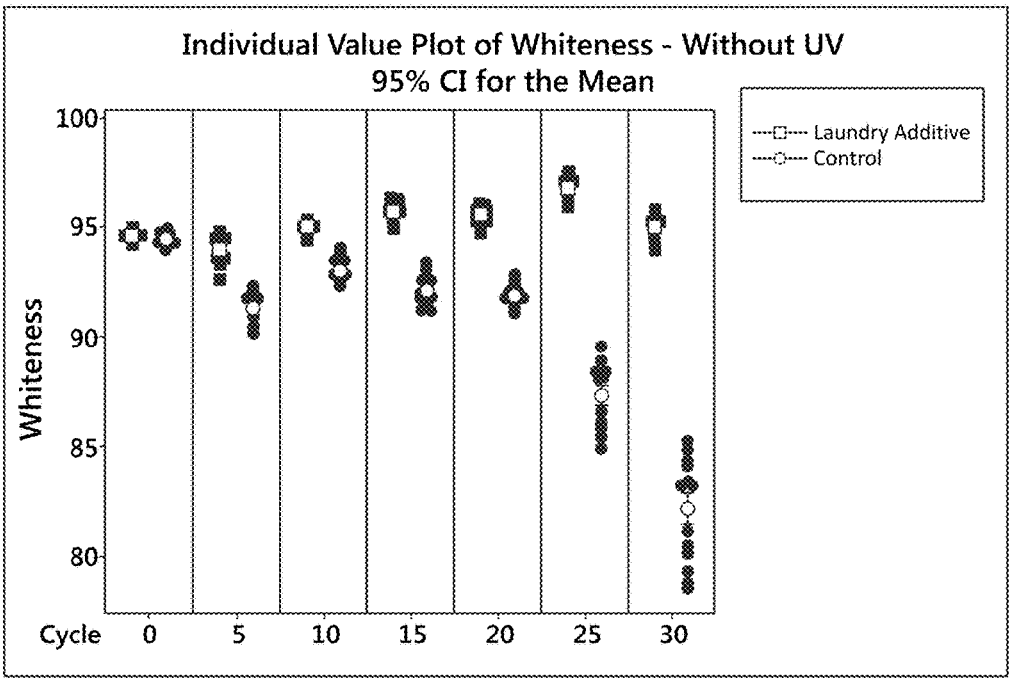
FIG. 6 shows a comparative whiteness evaluation of an embodiment of the laundry additive composition compared to negative control.

The relative whiteness of the fabric swatches were further evaluated in comparison to the Control (negative) to show the maintained whiteness over increasing number of cycles. FIG. 6 shows maintained whiteness over at least 30 cycles compared to Control with a sharp drop in whiteness (which visually corresponds to yellowing of the fabric). The whiteness measurements are shown as CIE standard illuminate D65 without UV, wherein a change in increment of 5 or greater is visually detectable by the average user on the whiteness scale.

Figure 7:
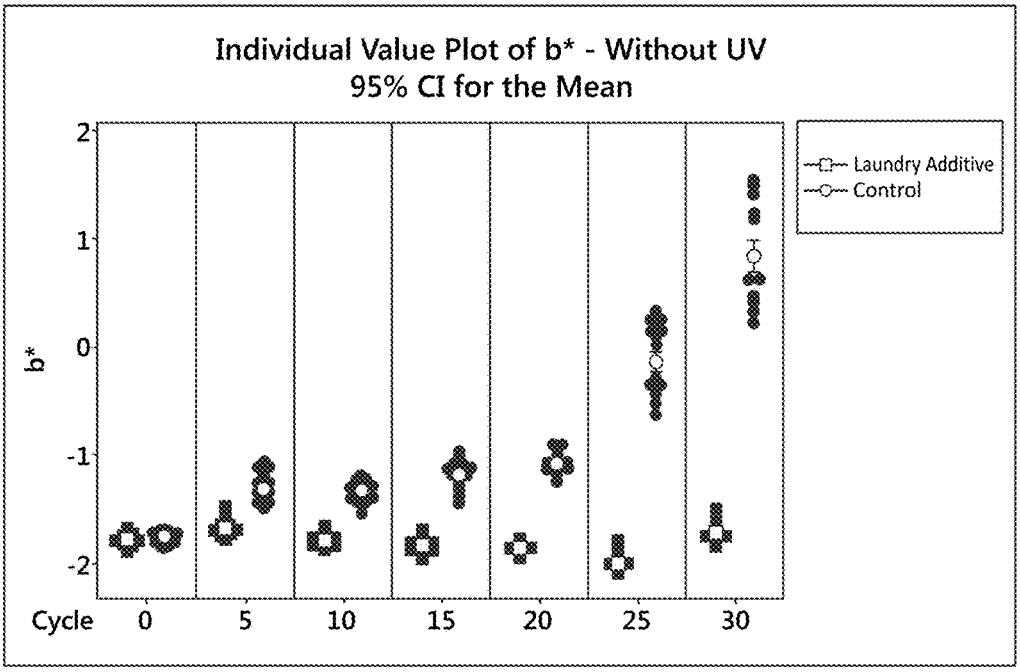
FIG. 7 shows a comparative yellow/blue evaluation of an embodiment of the laundry additive composition compared to negative control.

A similar analysis is shown in FIG. 7 where the b* value (evaluating yellow/blue as calculated according to CIE L*a*b* Color Scale, Jul. 1-15, 1996, Vol. 8, No. 7, available at http://cobra.rdsor.ro/cursuri/cielab.pdf, which is herein incorporated by reference in its entirety) over at least 30 cycles is compared to Control. It is desired to maintain a delta b* across the cycles constant. Again, the Laundry Additive Composition demonstrates a maintained low b* value (goal is delta b*=0, a change in 1 unit is noticeable to the visual assessment by an average user) which corresponds to commercially-desired whiteness of the fabrics.

This data beneficially demonstrates the Laundry Additive Composition controls (prevents) linen yellowing and outperform commercial Controls containing both an aminocarboxylate chelants and a carboxylate polymer. Without being limited according to a particular mechanism of action, the laundry additive composition containing a gluconate chelants in combination with an additional chelant (including an aminocarboxylate chelant) and a carboxylate polymer, outperforms the Controls due to the ability to control iron and other metals across the entire laundry process including alkaline pH where conventional chelants are not sufficiently stable, including while using a decreased concentration of the aminocarboxylate chelant.

Example 4

The order of addition of the laundry additive composition in relation to bleaching steps in a laundry process was evaluated. The testing staggered the bleach and laundry additive composition (described in Example 3) using a Tergotometer. There are four conditions evaluated included: Laundry Additive Composition followed by Bleach, Laundry Additive Composition dosed with Bleach, Bleach followed by Laundry Additive Composition, and Control with no Laundry Additive Composition. Polyester swatches from Test Fabrics were be evaluated by reflectance using a Hunterlab Spectrophotometer. The whiteness and b* values were reported.

Two separate sets of polyester swatches were used. The first set used a concentration similar to that of a Wash Wheel test and the second was consistent with typical Tergotometer lab testing, as shown in Table 3 (Concentration used for tergotometer testing. Set 1 (116 L/cwt) is more concentrated than Set 2 (227 L/cwt)). This was done to determine if bigger differences could be observed from one concentration over the other.

TABLE 3

| Chemistry | oz/cwt | Set 1 (g/L) | Set 2 (g/L) |
|---|---|---|---|
| Laundry Additive Composition | 3 | 0.88 | 0.45 |
| Commercially-available Bleach Destainer (Laundri Destainer) | 12 | 3.48 | 1.80 |

The procedure was as follows: Tergotometer water bath is heated to 150° F. To four pots, add 1 L 5GPG cold water and 2 ppm Iron (FeSO4.7H2O). Heat solution to 150° F. Follow Table 4 for test conditions in individual pots. The repeat for a total of 5 cycles for each condition.

TABLE 4

| Condition 1: Laundry Additive Composition before Bleach | Condition 2: Laundry Additive Composition and Bleach together | Condition 3: Laundry Additive Composition after Bleach | Condition 4: No Laundry Additive Composition |
|---|---|---|---|
| Add Laundry Additive Composition | Add Laundry Additive Composition + Chlorine Bleach | Add Chlorine Bleach | Add Chlorine Bleach |
| | | mix 1 min<br>Add swatch | |
| mix 2 min<br>add Chlorine Bleach | mix 6 min<br>remove swatch | mix 6 min<br>Add Laundry Additive Composition | mix 6 min<br>remove swatch |
| mix 6 min | rinse 5GPG cold water | mix 2 min | rinse 5GPG cold water |
| remove swatch<br>rinse 5GPG cold water<br>lay flat to dry | lay flat to dry | remove swatch<br>rinse 5GPG cold water<br>lay flat to dry | lay flat to dry |

Figure 8:
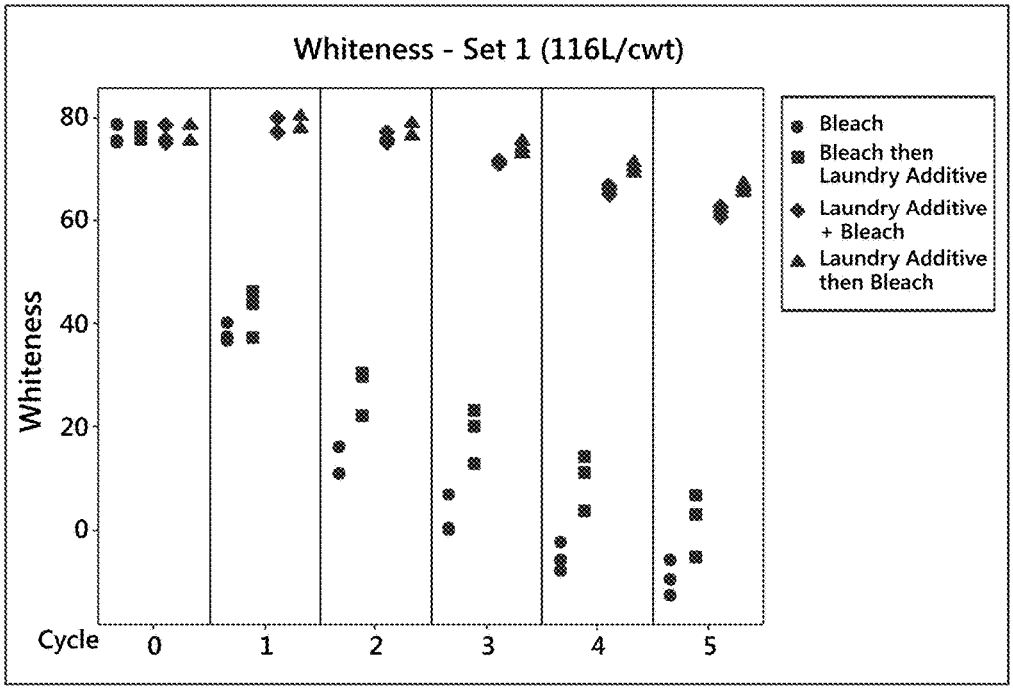
FIG. 8 shows measurement of whiteness based on the order of addition of the laundry additive composition, demonstrating a benefit in adding the laundry additive composition before or simultaneously with the bleach step.

Based on the results of this Example, the Laundry Additive Composition should be added either before the bleach step or simultaneously with the bleach (as depicted in FIG. 8). FIG. 8 shows an increased benefit in adding the Laundry Additive Composition before the bleach step and although adding Laundry Additive Composition after the bleach does provide some whitening it is preferred to dose before or with the bleach based on the data demonstrating both magnitude and direction of discoloration.

Example 5

Testing to control metals with polymers in oxidizing steps where chelants are not as effective due to lack of chlorine stability was conducted. The laundry additive composition includes a combination of both chelants and polymers to allow dosage throughout all steps of the wash process for metal control. This evaluation confirms the benefit of employing a polymer in the composition.

Figure 9:
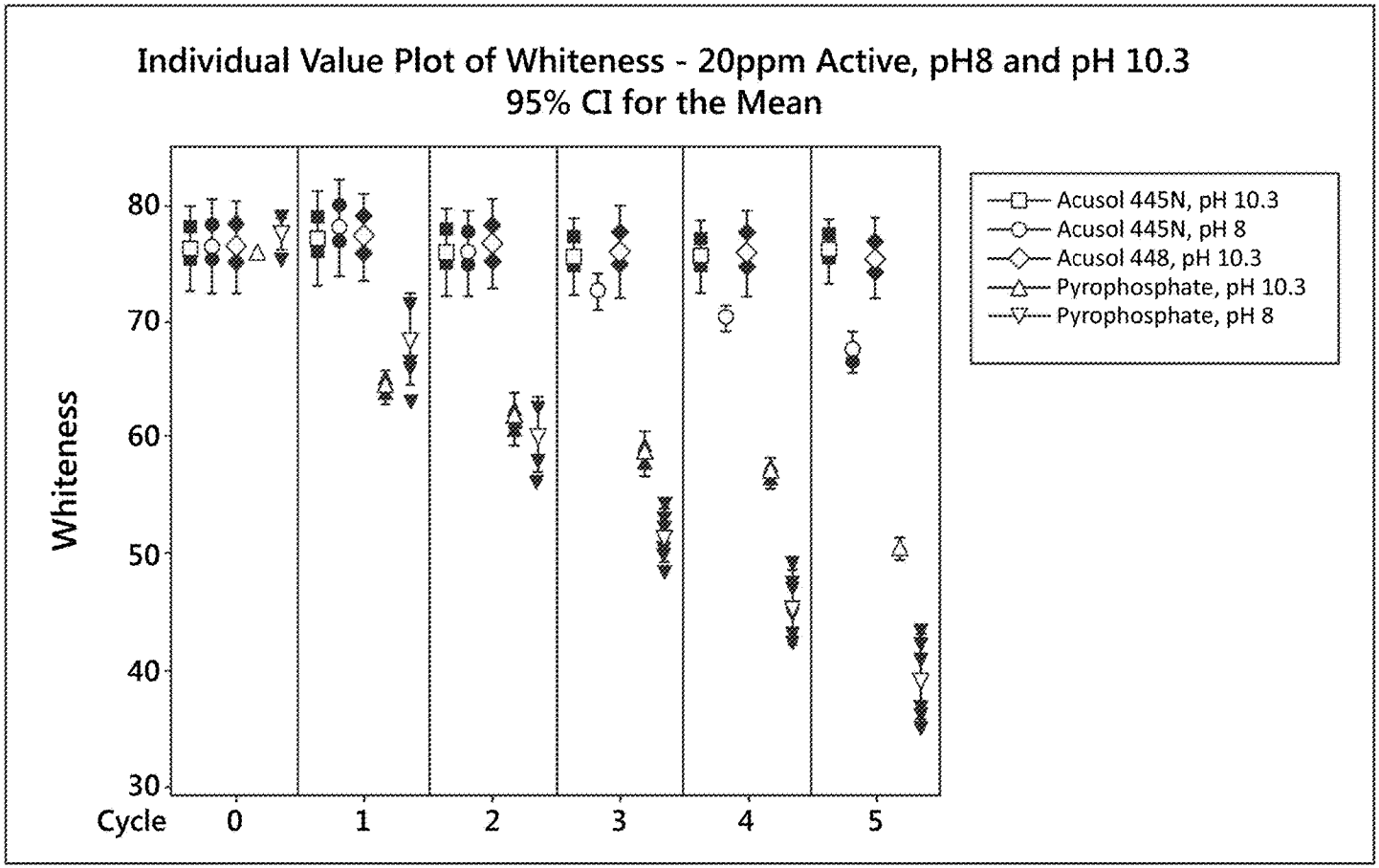
FIG. 9 shows whiteness measurements using various polymers in the laundry additive compositions at different alkaline pH ranges.

Whiteness testing was conducted to adjust for use pH in cycles employing the laundry additive compositions containing different polymers (Acusol 445N, Acusol 448, pyrophosphate). The pH of the test solutions were measured to be about pH 8 and also evaluated at pH 10.3 using NaOH 50% to verify the polymer would still perform. Using 20 ppm the polymer maintains performance as shown in FIG. 9. The data shows that the polymers outperform phosphonates in the laundry additive compositions.

Beneficially, the laundry additive compositions demonstrate ability to control iron and other metals across all of the laundry process as demonstrated here at various pH ranges. The stability of the laundry additive compositions is important to enable dosing to various points in a laundry application and under various conditions (e.g. pH). This is significant and prior compositions containing phosphates were stable (pH efficacy and regardless whether chlorine was present) in acid to alkaline pHs and oxidizing steps in a laundry process. Beneficially, the laundry additive composition unexpectedly achieves the same stability due to the combination of the gluconate chelants (particularly suitable for high pH), additional chelants, namely aminocarboxylates (particularly suitable for lower pH), and carboxylate polymers (particularly suitable for oxidizing conditions).

Example 6

Additional evaluations of six different manufactured towels selected from various customer accounts were split in half, whiteness readings taken, washed 29 times with whiteness readings taken at selected intervals. The towel samples were taken from locations having identified water conditions as a challenge to laundering, namely hard water and/or transition metal contaminants. Compositional Analysis: Samples of each half of the towels from samples 1, 4 and 6 were cut and ashed. Ashing removes the organic portion of the fabric in order to quantify the inorganic content. Inductively Coupled Plasma (ICP) was performed to determine the level of inorganics extracted from the towels. The results are shown in Table 6 where A refers to results after 29 washes using the Laundry Additive Composition according to Table 5, and B refers to the baseline (before and wash cycles).

TABLE 5

| Laundry Additive Composition | Wt-% |
|---|---|
| DTPA (aminopolycarboxylate chelant) | 4 |
| Polyacrylic and Polymaleic Acid polymers | 16.2 |
| Sodium Gluconate | 16 |
| MGDA | 1.7 |
| Water | 62.1 |

TABLE 6

| | Towel 1 | | Towel 4 | | Towel 6 | |
|---|---|---|---|---|---|---|
| | 1A | 1B | 4A | 4B | 6A | 6B |
| Aluminum (Al) | <4.15 mg/L | 8.57 mg/L | <4.37 mg/L | 20.7 mg/L | <3.87 mg/L | 5.23 mg/L |
| Barium (Ba) | 0.40 mg/L | 0.27 mg/L | 0.11 mg/L | 0.19 mg/L | 0.15 mg/L | 0.32 mg/L |
| Calcium (Ca) | 31.6 mg/L | 44.4 mg/L | 29.8 mg/L | 37.8 mg/L | 48.3 mg/L | 75.9 mg/L |
| Copper (Cu) | 0.10 mg/L | 0.16 mg/L | <0.09 mg/L | <0.08 mg/L | 0.09 mg/L | 0.16 mg/L |
| Iron (Fe) | 4.50 mg/L | 9.85 mg/L | 3.52 mg/L | 8.06 mg/L | 3.26 mg/L | 6.09 mg/L |
| Magnesium (Mg) | 8.50 mg/L | 13.0 mg/L | 8.52 mg/L | 9.13 mg/L | 12.9 mg/L | 16.5 mg/L |
| Manganese (Mn) | 0.06 mg/L | 0.12 mg/L | 0.05 mg/L | 0.09 mg/L | 0.07 mg/L | 0.09 mg/L |
| Phosphorus (P) | <2.08 mg/L | <2.68 mg/L | <2.18 mg/L | 2.35 mg/L | 3.70 mg/L | 4.72 mg/L |
| Potassium (K) | <20.8 mg/L | <26.8 mg/L | <21.8 mg/L | <19.6 mg/L | <19.3 mg/L | <16.2 mg/L |
| Silicon (Si) | 9.27 mg/L | 13.4 mg/L | 3.82 mg/L | 2.18 mg/L | 5.63 mg/L | 7.19 mg/L |
| Sodium (Na) | 261 mg/L | 215 mg/L | 222 mg/L | 124 mg/L | 333 mg/L | 320 mg/L |
| Sulfur (S) | 3.22 mg/L | 6.73 mg/L | <2.18 mg/L | <1.96 mg/ L | 4.56 mg/L | 8.45 mg/L |
| Zinc (Zn) | 0.47 mg/L | 1.11 mg/L | 0.52 mg/L | 0.68 mg/L | 0.38 mg/L | 1.00 mg/L |
| % Ash (wt %) | 0.06 | 0.06 | 0.08 | 0.07 | 0.09 | 0.10 |

In addition Scanning Electron Microscope (SEM) Analysis was preformed using a Hitachi S-3400 VP Scanning Electron Microscope (SEM) and images were collected using 3 magnifications. Thereafter Laboratory Color Change/Whiteness Testing was conducted using a Hunter UltraScan, the "L", "a", "b", "WI", and "YI" values were measured on all towel halves A and B. Delta E(ΔE) was calculated for comparison to baseline (samples labeled B). The samples were measured with the Ultra Violet (UV) filter IN and UV filter OUT. The UV filter is used to review the effects of optical brightener. When the UV filter is IN, UV rays are removed from the light source.

The "L" value is a measure of the white vs. black level of the textile; the higher the value the whiter the textile, the lower the more black.

The "a" value is a measure of the level of red vs. green color of the textiles. The higher the value, the more red color is present in the textile; the lower the value the greener the textile appears.

The "b" value measures the level of blue vs. yellow color of the textile, where the higher the value (+), the more yellow the textile; the lower (−) the value the more blue.

The "WI"—Whiteness index value measures overall whiteness. The higher the number, the whiter the sample is. A change of 4 units in the scale is visible to the human eye.

The "YI"—Yellowness index value measures overall yellowness that also takes the "b" value (blue vs. yellow) into account. The higher the number, the yellower the sample is.

Results of the UV filter after 29 washes of each of the towel samples are shown in Tables 7A-7B.

TABLE 7A

| UV FILTER IN AFTER 29 WASHES | | | | | | |
|---|---|---|---|---|---|---|
| | L* | a* | b* | WI E313 [D65/10] | YI E313 [D65/10] | Delta E (ΔE) |
| 1A IN | 96.49 | −0.10 | −0.45 | 93.22 | −0.97 | |
| 1B IN | 95.15 | 0.02 | 0.65 | 85.03 | 1.24 | |
| CHANGE | 1.34 | −0.12 | −1.10 | 8.19 | −2.21 | 1.74 |
| 2A IN | 96.91 | −0.16 | −0.50 | 94.42 | −1.09 | |
| 2B IN | 95.72 | 0.04 | 0.24 | 88.26 | 0.47 | |
| CHANGE | 1.19 | −0.20 | −0.74 | 6.16 | −1.56 | 1.42 |
| 3A IN | 96.91 | −0.25 | −0.51 | 94.50 | −1.18 | |
| 3B IN | 96.23 | −0.05 | 0.26 | 89.38 | 0.44 | |
| CHANGE | 0.68 | −0.20 | −0.77 | 5.12 | −1.62 | 1.05 |
| 4A IN | 97.01 | −0.18 | −0.41 | 94.31 | −0.95 | |
| 4B IN | 96.12 | 0.04 | 0.84 | 86.52 | 1.62 | |
| CHANGE | 0.89 | −0.22 | −1.25 | 7.79 | −2.57 | 1.55 |

TABLE 7A-continued

| UV FILTER IN AFTER 29 WASHES | | | | | | |
|---|---|---|---|---|---|---|
| | L* | a* | b* | WI E313 [D65/10] | YI E313 [D65/10] | Delta E (ΔE) |
| 5A IN | 96.94 | −0.44 | −0.40 | 94.05 | −1.11 | |
| 5B IN | 96.82 | −0.48 | −0.17 | 92.73 | −0.70 | |
| CHANGE | 0.12 | 0.04 | −0.23 | 1.32 | −0.41 | 0.26 |
| 6A IN | 97.15 | −0.29 | −0.60 | 95.44 | −1.38 | |
| 6B IN | 96.82 | −0.18 | 0.41 | 90.18 | 0.62 | |
| CHANGE | 0.33 | −0.11 | −1.01 | 5.26 | −2.00 | 1.07 |

TABLE 7B

| UV FILTER OUT AFTER 29 WASHES | | | | | | |
|---|---|---|---|---|---|---|
| | L* | a* | b* | WI E313 [D65/10] | YI E313 [D65/10] | Delta E (ΔE) |
| 1A OUT | 96.77 | 1.81 | −6.60 | 121.16 | −11.63 | |
| 1B OUT | 95.47 | 1.58 | −4.36 | 108.36 | −7.40 | |
| CHANGE | 1.30 | 0.23 | −2.24 | 12.80 | −4.23 | 2.60 |
| 2A OUT | 97.34 | 1.75 | −6.56 | 122.25 | −11.53 | |
| 2B OUT | 96.32 | 1.74. | −5.47 | 115.19 | −9.45 | |
| CHANGE | 1.02 | 0.01 | −1.09 | 7.06 | −2.08 | 1.49 |

TABLE 7B-continued

| UV FILTER OUT AFTER 29 WASHES | | | | | | |
|---|---|---|---|---|---|---|
| | L* | a* | b* | WI E313 [D65/10] | YI E313 [D65/10] | Delta E (ΔE) |
| 3A OUT | 97.59 | 1.70 | −6.74 | 123.57 | −11.91 | |
| 3B OUT | 96.54 | 1.70 | −5.42 | 115.44 | −9.35 | |
| CHANGE | 1.05 | 0.00 | −1.32 | 8.13 | −2.56 | 1.69 |
| 4A OUT | 97.49 | 1.76 | −6.73 | 123.36 | −11.87 | |
| 4B OUT | 96.27 | 1.33 | −3.17 | 104.81 | −5.16 | |
| CHANGE | 1.22 | 0.43 | −3.56 | 18.55 | −6.71 | 3.79 |
| 5A OUT | 97.82 | 1.62 | −7.31 | 126.58 | −13.10 | |
| 5B OUT | 97.11 | 1.52 | −7.00 | 123.70 | −12.64 | |
| CHANGE | 0.71 | 0.10 | −0.31 | 2.88 | −0.46 | 0.78 |
| 6A OUT | 97.93 | 1.76 | −7.15 | 126.14 | −12.66 | |
| 6B OUT | 97.31 | 1.64 | −5.42 | 117.19 | −9.34 | |
| CHANGE | 0.62 | 0.12 | −1.73 | 8.95 | −3.32 | 1.84 |

As shown in Tables 7A-7B, Whiteness Index (WI), Yellow Index (YI) and b* values significantly improved after 29 washes from baseline towels labeled B. Towel 5A values improved over 29 washes. The results of b* and YI values with the UV Filter OUT indicate the optical brighter has not been negatively affected by the washes. The b* and YI values have decreased, indicating less yellow over the 29 washes.

The data shows the importance of iron control in laundry applications using designed chelant compositions that do not result in deactivation of the polyacrylic acid polymers needed for water hardness control. Beneficially, by controlling the iron contaminants the polyacrylic acid s are able to control water hardness and prevents any encrustation and/or buildup on equipment employed in the laundering process.

Example 7

Additional Field Whiteness Testing was conducted with a portable Kinolta Minolta spectrophotometer at various washes. The baseline testing used an EDTA chelant product for cleaning. The towels had been used at various customer accounts and therefore were in different conditions at the onsite. The testing was designed to show an improvement over multiple (29) cycles using the Laundry Additive Composition. As each customer account may use different water sources, pH, oxidizer chemistries and the like providing wide variation in the testing conditions the need for a Laundry Additive Composition that is compatible across all conditions for laundering is evident.

Table 8 shows the whiteness testing from a customer site over 29 cycles.

TABLE 8

| | Whiteness |
|---|---|
| Start | 136.6 |
| Current | 156.0 |
| Change | 19.4 |

(+/−5 visible to naked eye)

Figure 10:
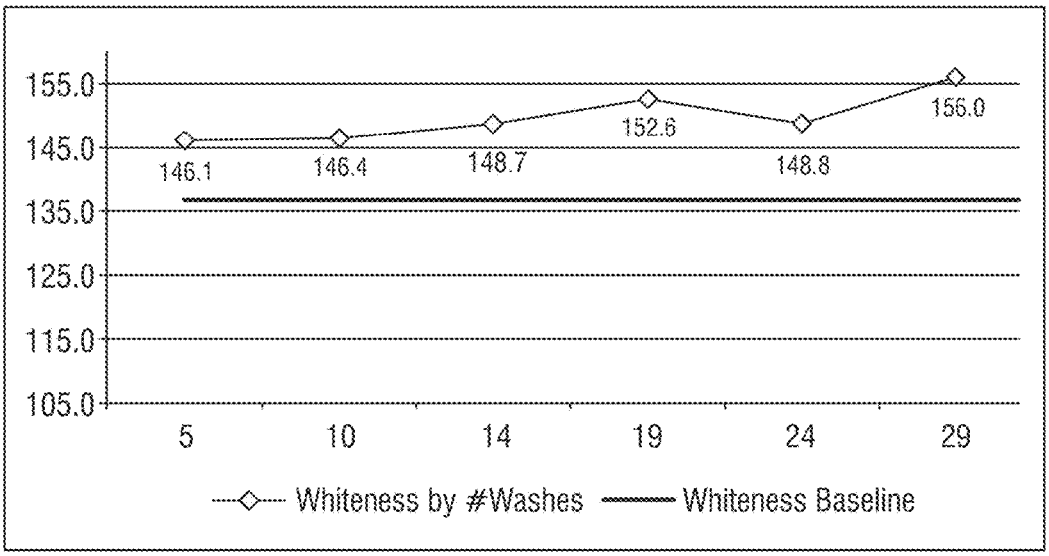
FIGS. 10-15 show whiteness measurements of towel sets (each FIG. 10-15 tested a separate set of towels) treated with the laundry additive composition to assess whiteness measurements over extended wash cycles compared to a baseline sample.

The results are also depicted in FIG. 10 showing improved whiteness performance in comparison to the baseline (no use Laundry Additive Composition).

Table 9 shows the whiteness testing from an additional customer site over 29 cycles.

TABLE 9

| | Whiteness |
|---|---|
| Start | 148.5 |
| Current | 158.5 |
| Change | 10.0 |

(+/−5 visible to naked eye)

Figure 11:
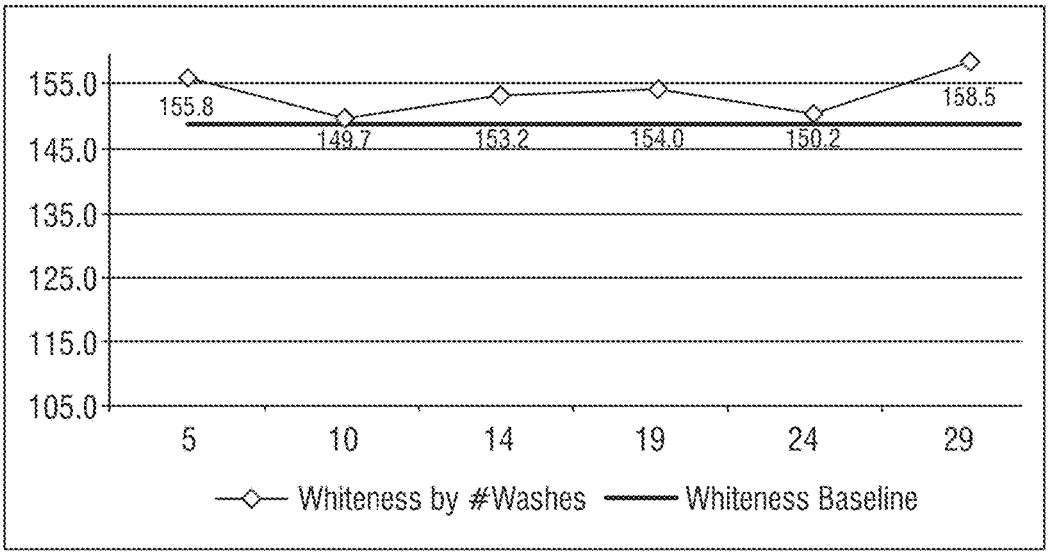

The results are also depicted in FIG. 11 showing improved whiteness performance in comparison to the baseline (no use Laundry Additive Composition).

Table 10 shows the whiteness testing from a customer site.

TABLE 10

| | Whiteness |
|---|---|
| Start | 147.6 |
| Current | 154.8 |
| Change | 7.2 |

(+/−5 visible to naked eye)

Figure 12:
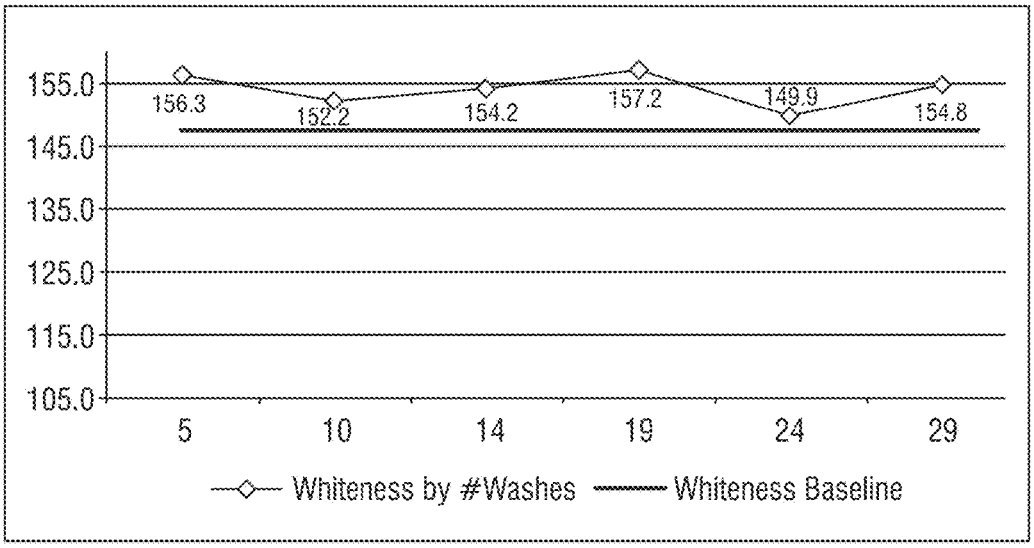

The results are also depicted in FIG. 12 showing improved whiteness performance in comparison to the baseline (no use Laundry Additive Composition).

Table 11 shows the whiteness testing from a customer site.

TABLE 11

| | Whiteness |
|---|---|
| Start | 127.9 |
| Current | 152.8 |
| Change | 24.9 |

(+/−5 visible to naked eye)

Figure 13:
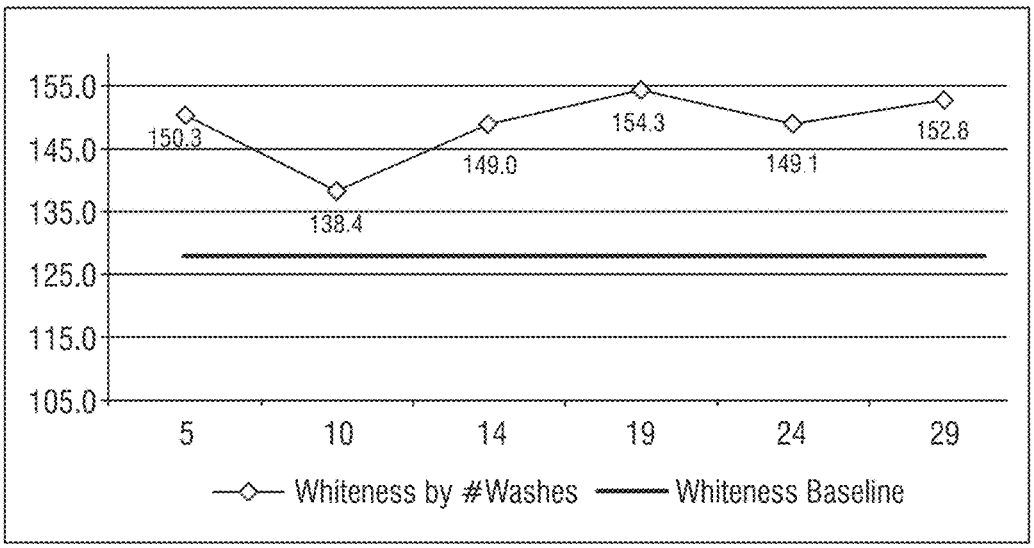

The results are also depicted in FIG. 13 showing improved whiteness performance in comparison to the baseline (no use Laundry Additive Composition).

Table 12 shows the whiteness testing from a customer site.

TABLE 12

| | Whiteness |
|---|---|
| Start | 159.3 |
| Current | 164.4 |
| Change | 5.1 |

(+/−5 visible to naked eye)

Figure 14:
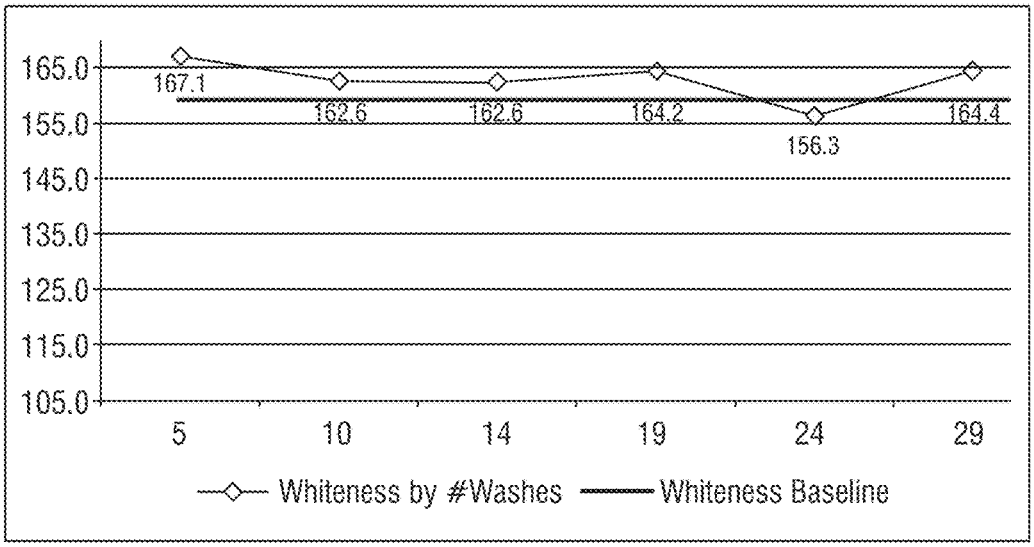

The results are also depicted in FIG. 14 showing improved whiteness performance in comparison to the baseline (no use Laundry Additive Composition).

Table 13 shows the whiteness testing from a customer site.

TABLE 13

| | Whiteness |
|---|---|
| Start | 147.5 |
| Current | 156.7 |
| Change | 9.2 |

(+/−5 visible to naked eye)

Figure 15:
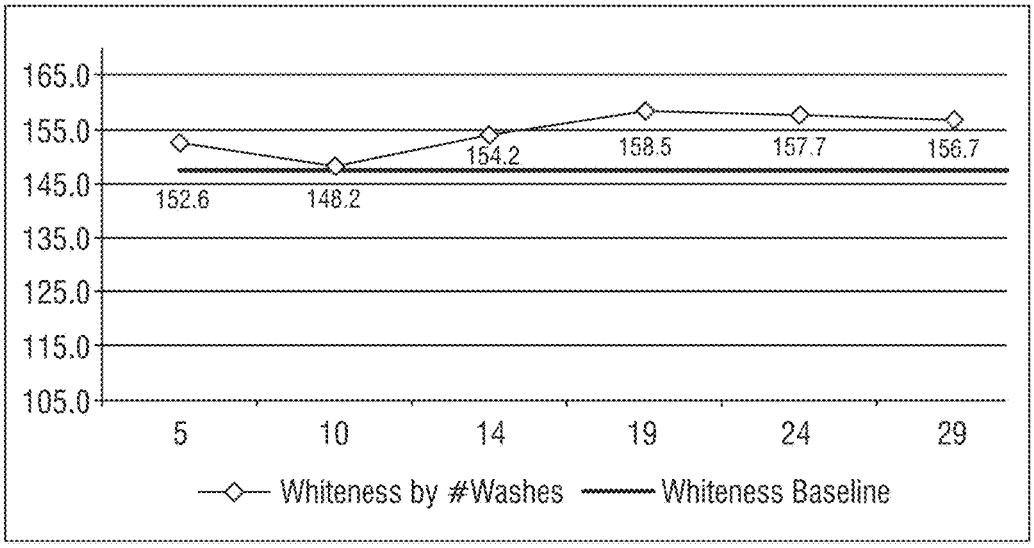

The results are also depicted in FIG. 15 showing improved whiteness performance in comparison to the baseline (no use Laundry Additive Composition).

Example 8

Additional testing to demonstrate the impact of unchelated iron on preventing polymers from properly controlling water hardness was conducted. Both yellow index values and ashing were performed according to the following procedure:

Testing was conducted using the launderometer. Samples were run for 20 cycles with DI and 20 GPG artificial water hardness with desired chemistry and removed at 5, 10, 15, and 20 cycles. Hunterlab was used to scan samples and obtain whiteness index and yellow index values, then samples were ashed and ICP conducted to determine total ash and iron.

Temperature: 140° F.

Water hardness: DI+2.5 g chelation soln (20 GPG) (33.45 g $CaCl_2.2H_2O$+23.24 g $MgCl_2.6H_2O$)

Chemistry: 1.5 g/l NaOH (50%) to all pots+desired chemistry

Time: 10 minutes

Rinse swatches with 17 GPG water between cycles. Use new wash bath for each cycle.

12 swatches per pot 20 cycles of each condition

Samples taken at cycles 0, 5, 10, 15, and 20 cycles

Target 10:1 ratio of water to linen weight—250 g water for 12 swatches with 20 steels balls.

Set launderometer to 50 rpm.

Table 14 shows the factors analyzed where the activity on a gram/liter basis were matched.

TABLE 14

| Run | Factor 1 A: FeCl2 ppm Fe | Factor 2 B: Acusol 445 g/L | Factor 3 C: MGDA g/L | Factor 4 D: Sodium Gluconate g/L |
|---|---|---|---|---|
| 1 | 10 | 0 | 1.25 | 0 |
| 2 | 0 | 0 | 0 | 0.5 |
| 3 | 0 | 0 | 1.25 | 0 |
| 4 | 10 | 0 | 1.25 | 0.5 |
| 5 | 0 | 0 | 0 | 0 |
| 6 | 0 | 0.5 | 1.25 | 0 |
| 7 | 0 | 0.5 | 0 | 0.5 |
| 8 | 10 | 0.5 | 0 | 0 |
| 9 | 10 | 0.5 | 0 | 0.5 |
| 10 | 0 | 0 | 1.25 | 0.5 |
| 11 | 0 | 0.5 | 0 | 0 |
| 12 | 0 | 0.5 | 1.25 | 0.5 |
| 13 | 10 | 0 | 0 | 0 |
| 14 | 10 | 0 | 0 | 0.5 |
| 15 | 10 | 0.5 | 1.25 | 0.5 |
| 16 | 10 | 0.5 | 1.25 | 0 |

MGDA and sodium gluconate were used at equal active levels. The results of the change in whiteness index and the change in yellow index have similar trends. MGDA with iron was outperformed by all other chemistries. The results confirm the polyacrylic acid is disrupting the iron from depositing on the linen. Overall, the Acusol 445 combined with a gluconate salt and additional chelator performed well.

The results are further depicted in FIGS. 16-27 wherein the various assessments were conducted over 20 cycles.

Figure 16:
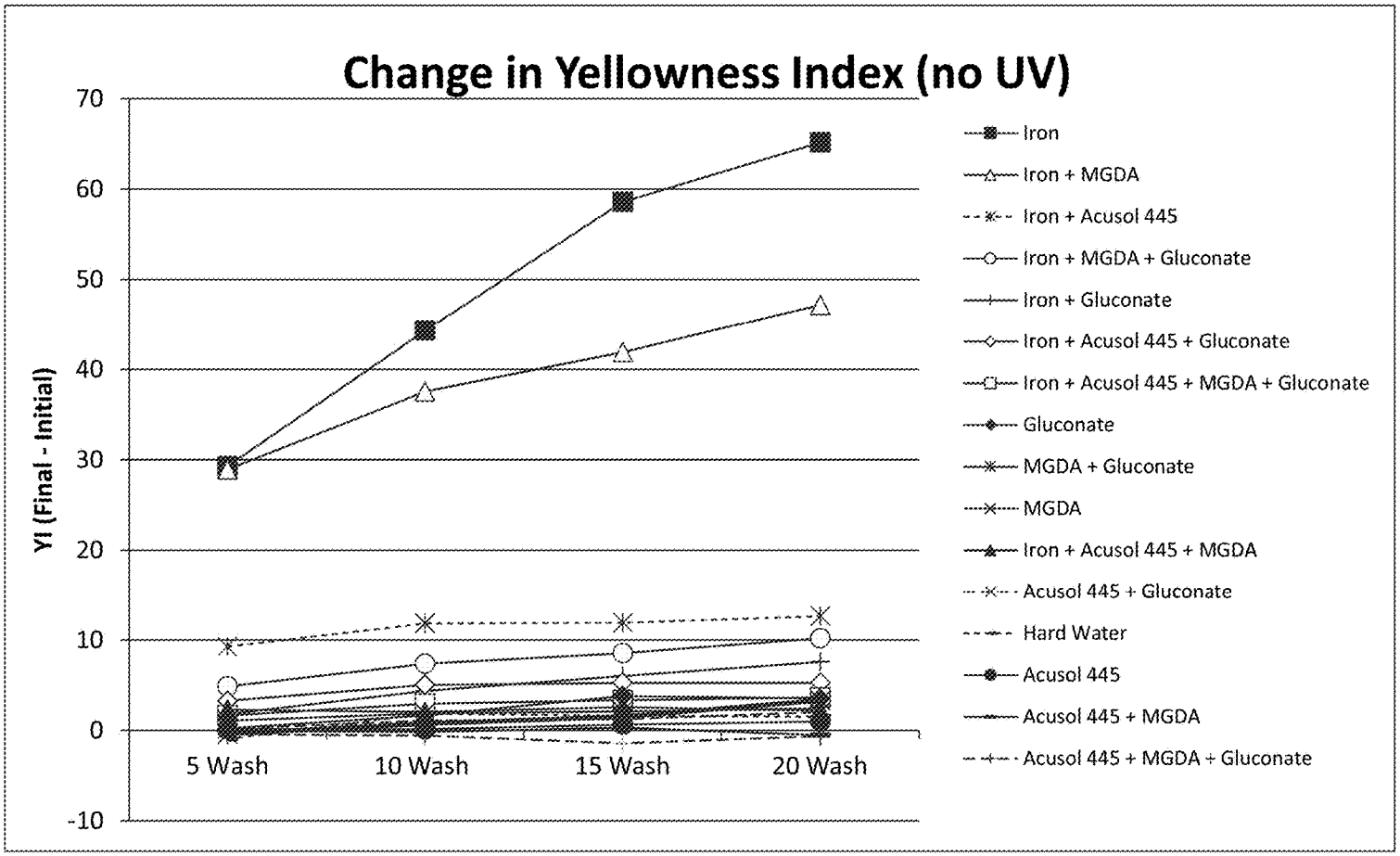
FIG. 16 shows the measurement of change in yellowness (without UV) of swatches evaluated to assess the impact of unchelated iron in preventing the polymers of the laundry additive composition from controlling the water hardness.

FIG. 16 shows the measurement of change in yellowness (without UV) of the towel swatches evaluated according to the Yellowness index value measuring overall yellowness that also takes the "b" value (blue vs. yellow) into account. The results are also shown in Table 15. As shown, the samples with iron and no chelant/polymer package provided the greatest YI, indicating the most yellow sample. The use of a chelant and/or polymer alone was unable to sufficiently reduce the YI in the presence of iron.

TABLE 15

Yellow Index (no UV, Final-Initial)

| Condition | 5 Wash | 10 Wash | 15 Wash | 20 Wash |
|---|---|---|---|---|
| Iron + MGDA | 28.9 | 37.5 | 41.9 | 47.2 |
| Gluconate | 0.2 | 1.7 | 3.8 | 3.5 |
| MGDA | 1.1 | 1.9 | 2.1 | 2.4 |
| Iron + MGDA + Gluconate | 4.9 | 7.4 | 8.5 | 10.2 |
| Hard Water | −1.0 | 1.9 | 1.6 | 1.5 |
| Acusol 445 + MGDA | −0.1 | −0.2 | 0.3 | −0.5 |
| Acusol 445 + Gluconate | 0.2 | 1.1 | 1.2 | 2.0 |
| Iron + Acusol 445 | 9.3 | 11.8 | 11.9 | 12.6 |
| Iron + Acusol 445 + Gluconate | 3.3 | 5.0 | 5.2 | 5.3 |
| MGDA + Gluconate | −0.4 | 0.8 | 1.5 | 3.3 |
| Acusol 445 | 0.1 | 0.1 | 0.6 | 1.0 |
| Acusol 445 + MGDA + Gluconate | −0.4 | −0.6 | −1.4 | −0.6 |
| Iron | 29.3 | 44.3 | 58.6 | 65.2 |
| Iron + Gluconate | 1.8 | 4.4 | 6.0 | 7.6 |
| Iron + Acusol 445 + MGDA + Gluconate | 1.7 | 3.0 | 3.4 | 3.6 |
| Iron + Acusol 445 + MGDA | 2.3 | 2.0 | 2.6 | 2.2 |

Figure 17:
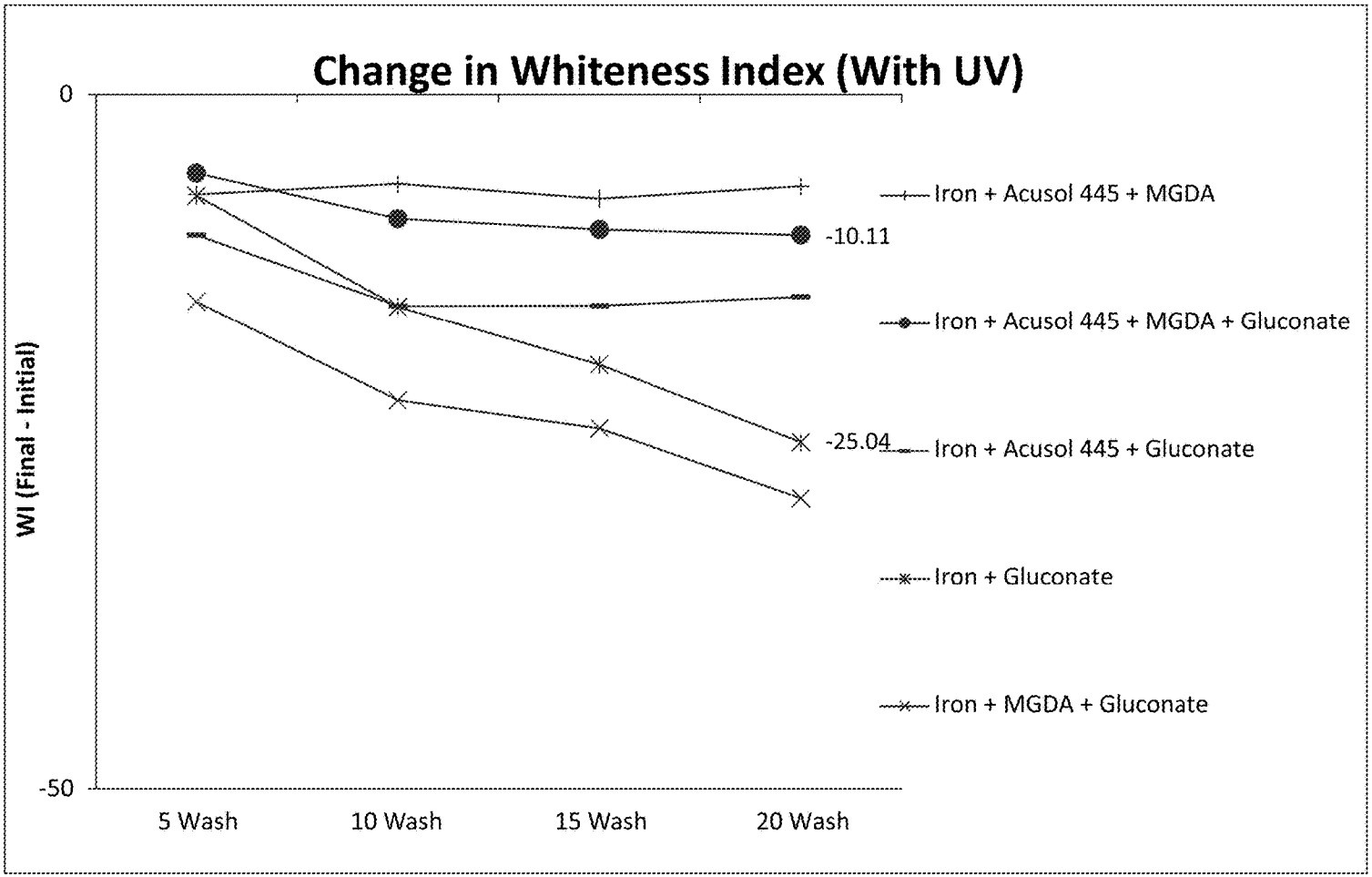
FIG. 17 shows the measurement of change in whiteness (without UV) of swatches evaluated to assess the impact of unchelated iron in preventing the polymers of the laundry additive composition from controlling the water hardness.

FIG. 17 shows the measurement of change in whiteness (without UV) of swatches evaluated to assess the impact of unchelated iron in preventing the polymers of the laundry additive composition from controlling the water hardness. The whiteness index value measures overall whiteness and the higher the number, the whiter the sample is. A result approximating zero is desired. The results are also shown in Table 16 and show that the combination of polymer, MGDA and gluconate without iron is the preferred embodiment as whiteness improved (positive value or final is greater than initial). All of the runs in Table 16 are in the presence of hard water (Water hardness: DI+2.5 g chelation soln (20 GPG) (33.45 g $CaCl_2.2H_2O$+23.24 g $MgCl_2.6H_2O$)).

In the presence of iron, most samples degraded by the results of more negative delta whiteness values. The same combination of polymer, MGDA and gluconate is one of the smaller changes as well showing this as the preferred balance in hard water and transition metal contamination sources.

TABLE 16

Whiteness Index (no UV, Final-Initial)

| Condition | 5 Wash | 10 Wash | 15 Wash | 20 Wash |
|---|---|---|---|---|
| Iron + MGDA | −79.8 | −104.6 | −117.3 | −132.9 |
| Gluconate | −2.8 | −6.8 | −14.0 | −14.0 |
| MGDA | −4.3 | −6.8 | −7.1 | −8.2 |
| Iron + MGDA + Gluconate | −14.9 | −22.0 | −24.0 | −29.1 |
| Hard Water | 0.3 | −7.1 | −6.9 | −6.5 |
| Acusol 445 + MGDA | −1.6 | −0.6 | −1.5 | 0.8 |
| Acusol 445 + Gluconate | −1.6 | −4.3 | −4.4 | −7.2 |
| Iron + Acusol 445 | −26.5 | −32.9 | −33.1 | −35.2 |
| Iron + Acusol 445 + Gluconate | −10.1 | −15.2 | −15.2 | −14.6 |
| MGDA + Gluconate | −0.8 | −4.1 | −5.8 | −10.9 |
| Acusol 445 | −2.3 | −2.4 | −4.0 | −4.8 |
| Acusol 445 + MGDA + Gluconate | −0.1 | 0.8 | 4.1 | 1.2 |
| Iron | −81.4 | −124.9 | −166.6 | −186.3 |
| Iron + Gluconate | −7.3 | −15.3 | −19.5 | −25.0 |
| Iron + Acusol 445 + MGDA + Gluconate | −5.7 | −8.9 | −9.7 | −10.1 |
| Iron + Acusol 445 + MGDA | −7.2 | −6.4 | −7.5 | −6.6 |

Figure 18:
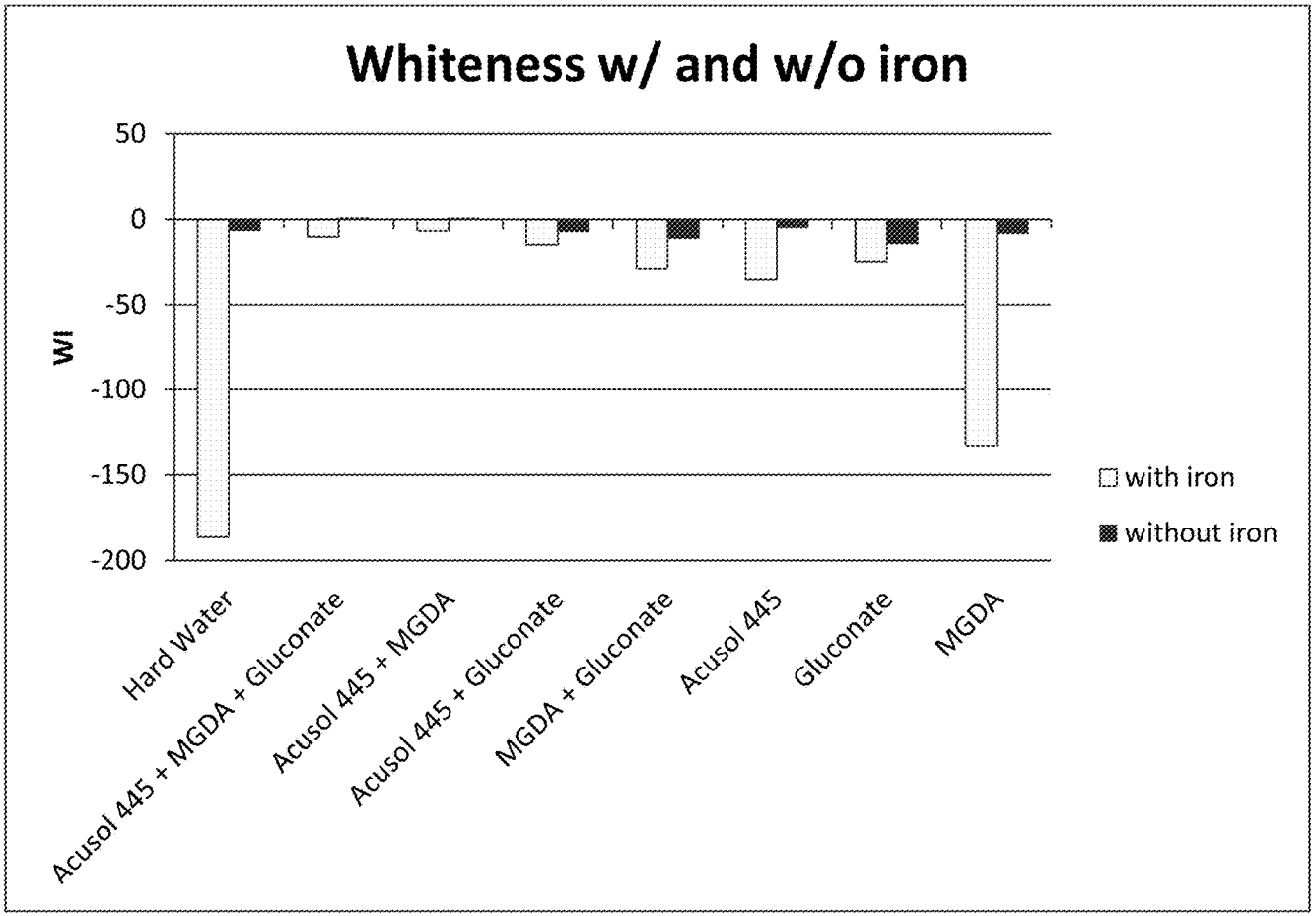
FIG. 18 shows the measurement of whiteness (with and without iron) from the evaluated polymers and conditions described.

FIG. 18 shows the measurement of whiteness (with and without iron) from the evaluated polymers and conditions according to the whiteness index value. In this depiction of the results the WI with and without iron in the formulations are shown in the graph confirming the detrimental impact of iron on laundry substrates.

Figure 19:
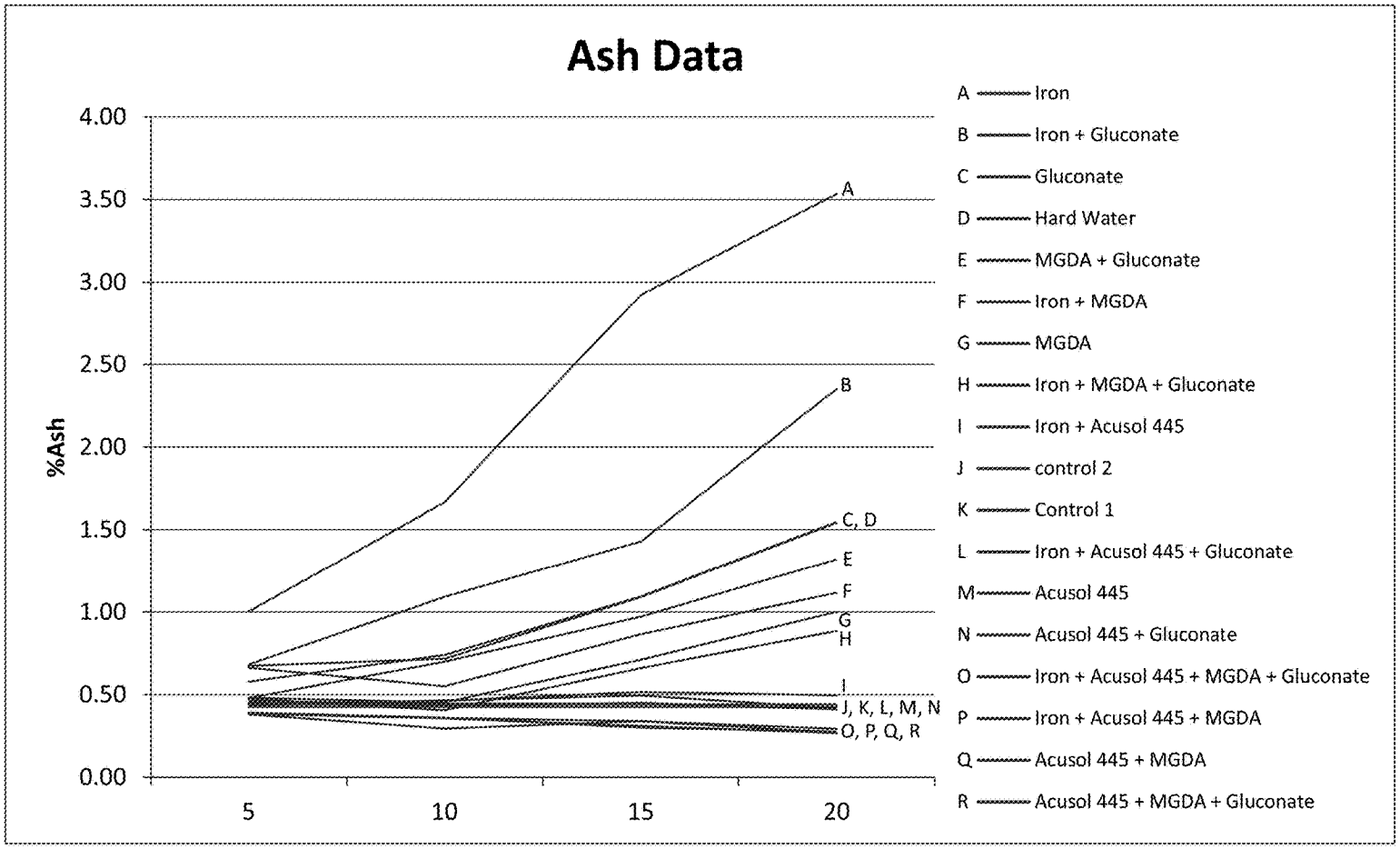
FIG. 19 shows the measurement of percentage of ash that is on the evaluated swatches as deposits as an indicator of cause of discoloration of treated substrates under various conditions of washing.

FIG. 19 and Table 17 show the measurement of percentage of ash that is on the evaluated swatches as deposits as an indicator of cause of discoloration of treated substrates under the various evaluated conditions. The measurement of ash takes into account all deposits—both transition metal contaminants and alkaline earth metals (such as water hardness) deposits on the substrates.

TABLE 17

| % Ash | | | | |
|---|---|---|---|---|
| | 5 Wash | 10 Wash | 15 Wash | 20 Wash |
| Iron + MGDA | 0.66 | 0.55 | 0.86 | 1.12 |
| Gluconate | 0.58 | 0.74 | 1.09 | 1.55 |
| MGDA | 0.48 | 0.45 | 0.71 | 1.00 |
| Iron + MGDA + Gluconate | 0.48 | 0.41 | 0.66 | 0.89 |
| Hard Water | 0.67 | 0.72 | 1.09 | 1.54 |
| Acusol 445 + MGDA | 0.38 | 0.29 | 0.34 | 0.27 |
| Acusol 445 + Gluconate | 0.45 | 0.43 | 0.45 | 0.41 |
| Iron + Acusol 445 | 0.44 | 0.46 | 0.52 | 0.50 |
| Iron + Acusol 445 + Gluconate | 0.44 | 0.47 | 0.49 | 0.42 |
| MGDA + Gluconate | 0.48 | 0.70 | 0.97 | 1.32 |
| Acusol 445 | 0.46 | 0.45 | 0.45 | 0.41 |
| Acusol 445 + MGDA + Gluconate | 0.38 | 0.36 | 0.31 | 0.27 |
| Iron | 1.00 | 1.67 | 2.92 | 3.53 |
| Iron + Gluconate | 0.68 | 1.09 | 1.43 | 2.35 |
| Iron + Acusol 445 + MGDA + Gluconate | 0.39 | 0.36 | 0.34 | 0.29 |
| Iron + Acusol 445 + MGDA | 0.39 | 0.36 | 0.30 | 0.28 |
| Control 1 | 0.43 | 0.43 | 0.43 | 0.43 |
| Control 2 | 0.44 | 0.44 | 0.44 | 0.44 |

Figure 20:
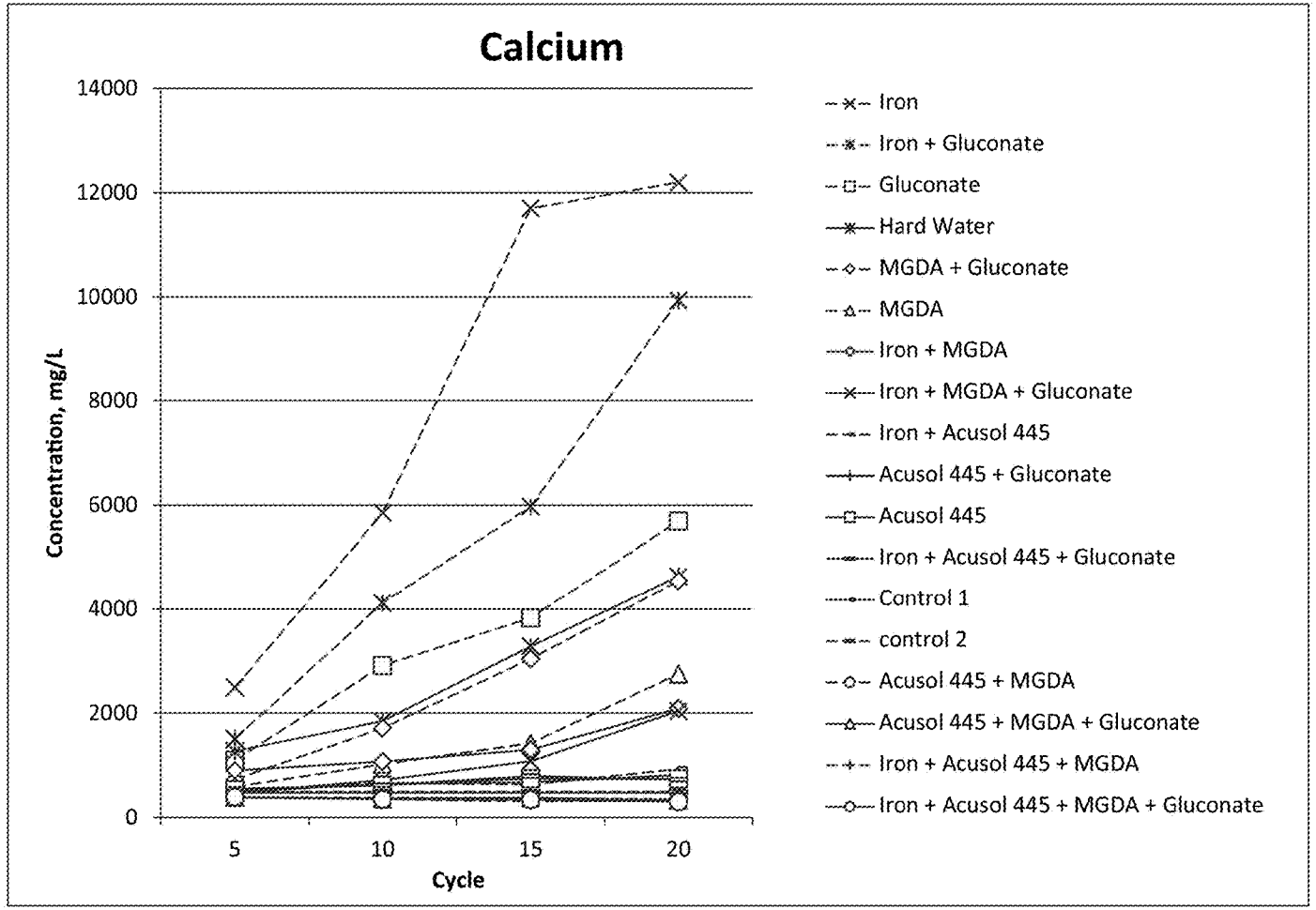
FIG. 20 shows the measurement of concentration of calcium (mg/L) over 20 cycles of washing using various polymers and chelant conditions to assess impact of contaminated water and/or soil sources.

FIG. 20 and Table 18 show the measurement of concentration of calcium (mg/L) deposits on the substrate over 20 cycles of washing using various polymers and chelant conditions to assess impact of contaminated water and/or soil sources. Calcium contaminants less than about 500 ppm (mg/L) or preferably 300 ppm (mg/L) are preferred, which are achieved by the Laundry Additive Composition (Iron+Acusol 445+MGDA+Gluconate).

TABLE 18

| Calcium (mg/L) | | | | |
|---|---|---|---|---|
| | 5 Wash | 10 Wash | 15 Wash | 20 Wash |
| Iron + MGDA | 899 | 1070 | 1300 | 2090 |
| Gluconate | 1100 | 2910 | 3830 | 5690 |
| MGDA | 587 | 1020 | 1420 | 2750 |
| Iron + MGDA + Gluconate | 470 | 717 | 1080 | 2040 |
| Hard Water | 1270 | 1850 | 3280 | 4630 |
| Acusol 445 + MGDA | 384 | 378 | 371 | 349 |
| Acusol 445 + Gluconate | 489 | 646 | 676 | 812 |
| Iron + Acusol 445 | 503 | 665 | 630 | 928 |
| Iron + Acusol 445 + Gluconate | 547 | 616 | 793 | 729 |
| MGDA + Gluconate | 729 | 1710 | 3040 | 4540 |
| Acusol 445 | 532 | 619 | 746 | 738 |
| Acusol 445 + MGDA + Gluconate | 384 | 360 | 375 | 330 |
| Iron | 2490 | 5850 | 11700 | 12200 |
| Iron + Gluconate | 1500 | 4120 | 5970 | 9930 |
| Iron + Acusol 445 + MGDA + Gluconate | 393 | 348 | 339 | 303 |
| Iron + Acusol 445 + MGDA | 384 | 355 | 307 | 325 |
| Control 1 | 476 | 476 | 476 | 476 |
| control 2 | 496 | 496 | 496 | 496 |

Figure 21:
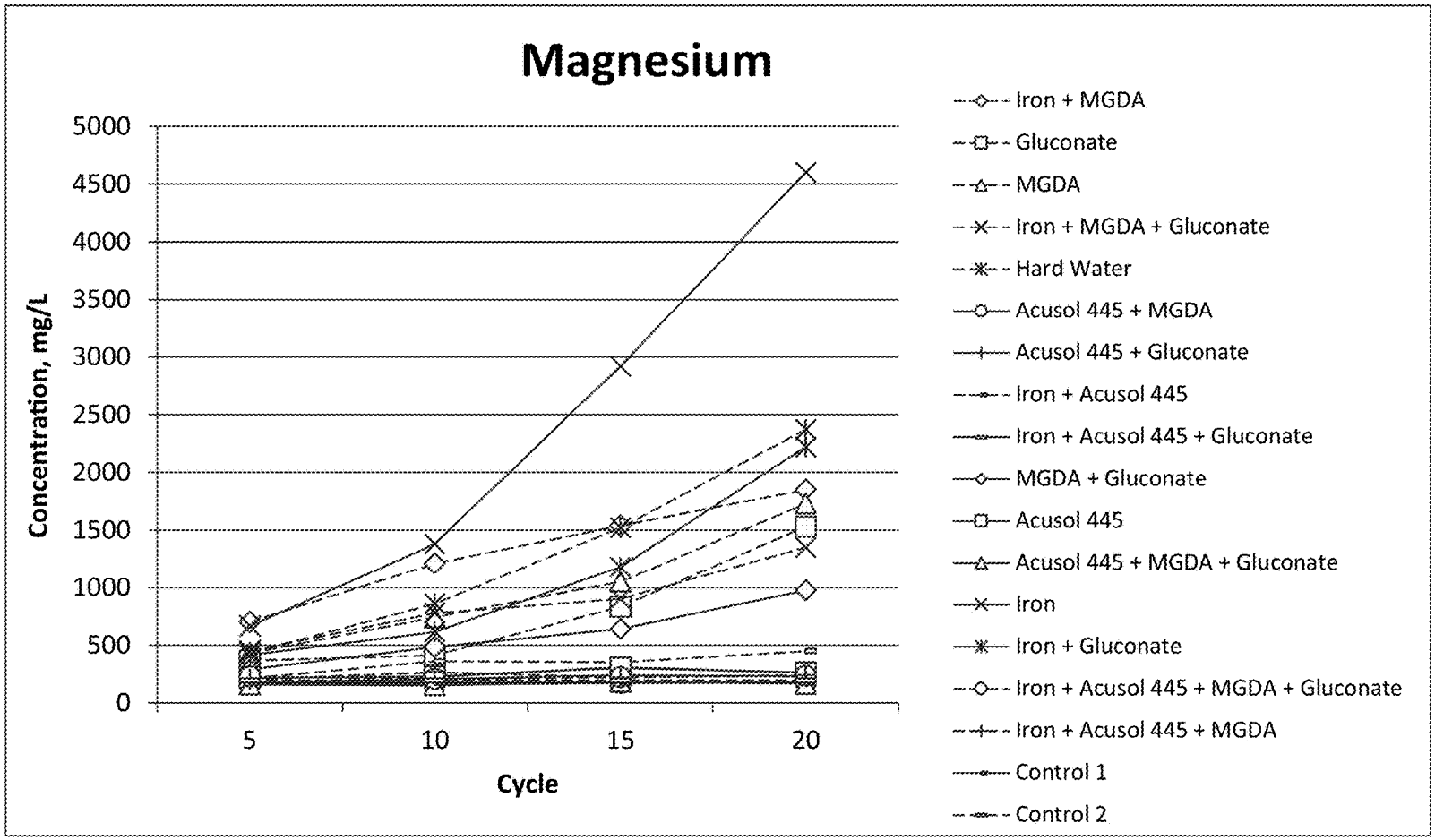
FIG. 21 shows the measurement of concentration of magnesium (mg/L) over 20 cycles of washing using various polymers and chelant conditions to assess impact of contaminated water and/or soil sources.

FIG. 21 and Table 19 show the measurement of concentration of magnesium (mg/L) deposits on the substrate over 20 cycles of washing using various polymers and chelant conditions to assess impact of contaminated water and/or soil sources. Magnesium contaminants less than about 500 ppm (mg/L) or preferably 300 ppm (mg/L) are preferred, which are achieved by the Laundry Additive Composition (Iron+Acusol 445+MGDA+Gluconate).

TABLE 19

| Magnesium (mg/L) | | | | |
|---|---|---|---|---|
| | 5 Wash | 10 Wash | 15 Wash | 20 Wash |
| Iron + MGDA | 701 | 1210 | 1540 | 1850 |
| Gluconate | 366 | 411 | 831 | 1530 |
| MGDA | 429 | 742 | 1050 | 1730 |
| Iron + MGDA + Gluconate | 450 | 778 | 900 | 1350 |
| Hard Water | 431 | 857 | 1520 | 2370 |
| Acusol 445 + MGDA | 162 | 158 | 173 | 177 |
| Acusol 445 + Gluconate | 175 | 206 | 240 | 228 |
| Iron + Acusol 445 | 212 | 362 | 351 | 447 |
| Iron + Acusol 445 + Gluconate | 219 | 227 | 308 | 261 |
| MGDA + Gluconate | 290 | 485 | 639 | 974 |
| Acusol 445 | 217 | 230 | 303 | 263 |
| Acusol 445 + MGDA + Gluconate | 160 | 153 | 184 | 166 |
| Iron | 664 | 1380 | 2920 | 4600 |
| Iron + Gluconate | 415 | 614 | 1180 | 2220 |
| Iron + Acusol 445 + MGDA + Gluconate | 230 | 208 | 224 | 236 |
| Iron + Acusol 445 + MGDA | 203 | 265 | 221 | 240 |
| Control 1 | 175 | 175 | 175 | 175 |
| control 2 | 194 | 194 | 194 | 194 |

Figure 22:
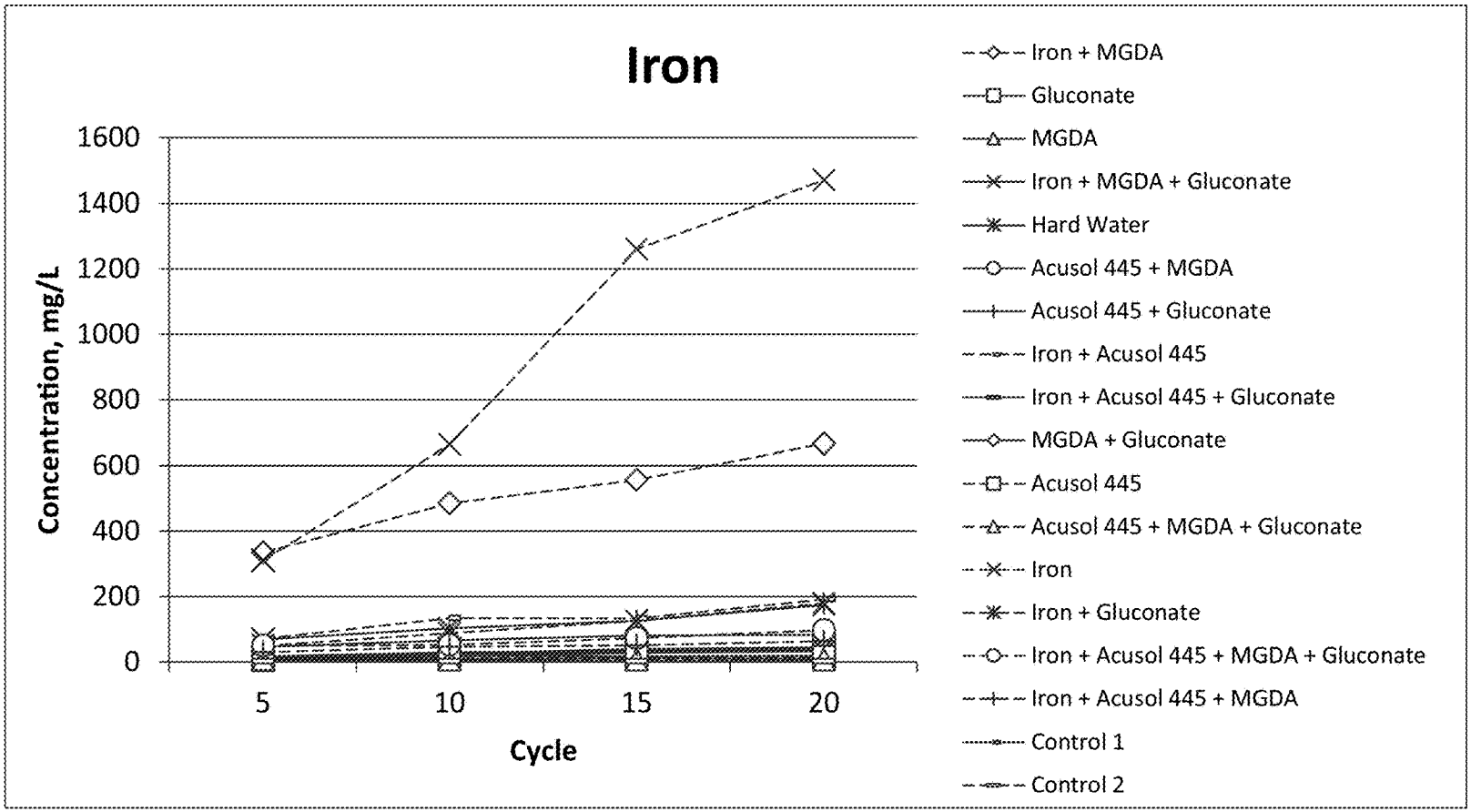
FIG. 22 shows the measurement of concentration of iron (mg/L) over 20 cycles of washing using various polymers and chelant conditions to assess impact of contaminated water and/or soil sources.

FIG. 22 and Table 20 show the measurement of concentration of iron (mg/L) over 20 cycles of washing using various polymers and chelant conditions to assess impact of contaminated water and/or soil sources. Iron contaminants less than about 35 ppm (mg/L) are preferred, which are achieved by the Laundry Additive Composition (Iron+Acusol 445+MGDA+Gluconate).

TABLE 20

| Iron (mg/L) | | | | |
|---|---|---|---|---|
| | 5 Wash | 10 Wash | 15 Wash | 20 Wash |
| Iron + MGDA | 334 | 484 | 556 | 666 |
| Gluconate | 17 | 26 | 39 | 44 |
| MGDA | 17 | 29 | 34 | 42 |
| Iron + MGDA + Gluconate | 69 | 103 | 126 | 174 |
| Hard Water | 9 | 24 | 29 | 32 |
| Acusol 445 + MGDA | 7 | 8 | 11 | 9 |
| Acusol 445 + Gluconate | 15 | 19 | 18 | 19 |
| Iron + Acusol 445 | 70 | 134 | 133 | 191 |
| Iron + Acusol 445 + Gluconate | 46 | 66 | 81 | 83 |
| MGDA + Gluconate | 10 | 16 | 28 | 37 |
| Acusol 445 | 6 | 11 | 15 | 15 |
| Acusol 445 + MGDA + Gluconate | 8 | 7 | 7 | 7 |
| Iron | 310 | 663 | 1260 | 1470 |
| Iron + Gluconate | 49 | 88 | 126 | 179 |
| Iron + Acusol 445 + MGDA + Gluconate | 50 | 52 | 73 | 97 |
| Iron + Acusol 445 + MGDA | 30 | 46 | 50 | 63 |
| Control 1 | 3 | 3 | 3 | 3 |
| control 2 | 3 | 3 | 3 | 3 |

Figure 23:
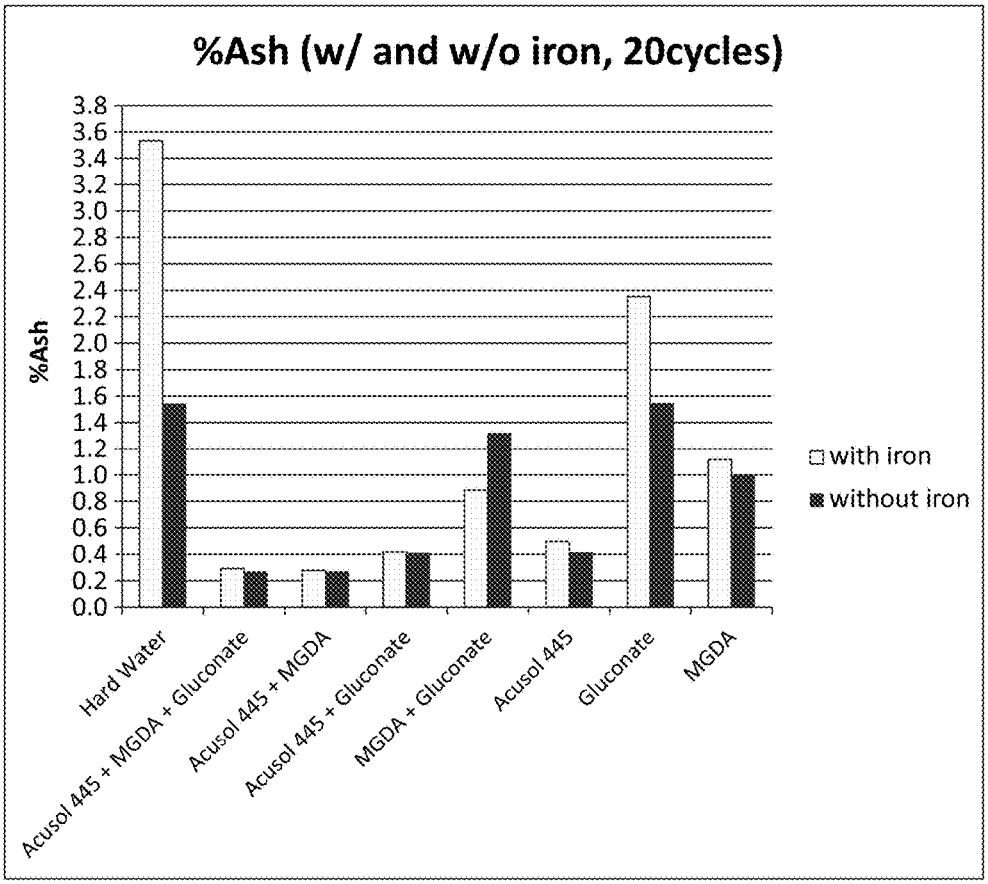
FIG. 23 shows the measurement of percentage of ash that is on the evaluated swatches—with and without iron contaminants—as an indicator of cause of discoloration of treated substrates under various conditions of washing.

FIG. 23 shows the measurement of percentage of ash that is on the evaluated swatches—with and without iron contaminants—as an indicator of cause of discoloration of treated substrates under various conditions of washing.

Figure 24:
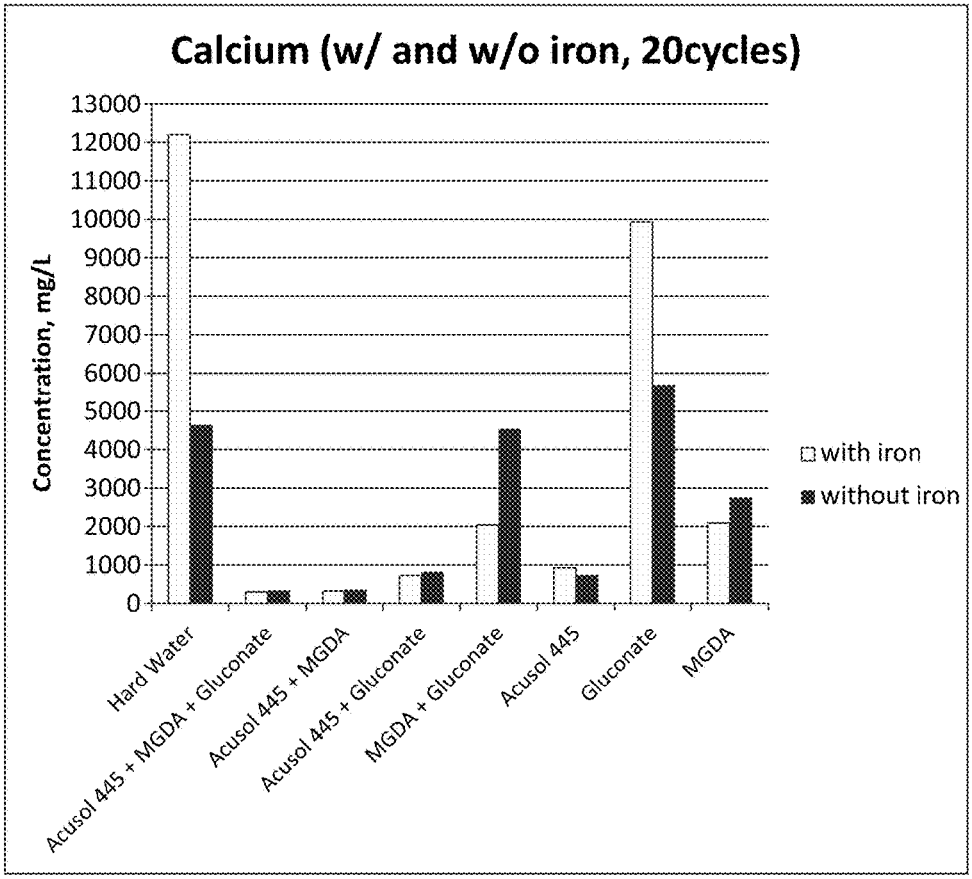
FIG. 24 shows the measurement of concentration of calcium (mg/L)—with and without iron contaminants—using various polymers and chelant conditions to assess impact of contaminated water and/or soil sources.

FIG. 24 shows the measurement of concentration of calcium (mg/L) deposits on the substrate—with and without iron contaminants—using various polymers and chelant conditions to assess impact of contaminated water and/or soil sources.

Figure 25:
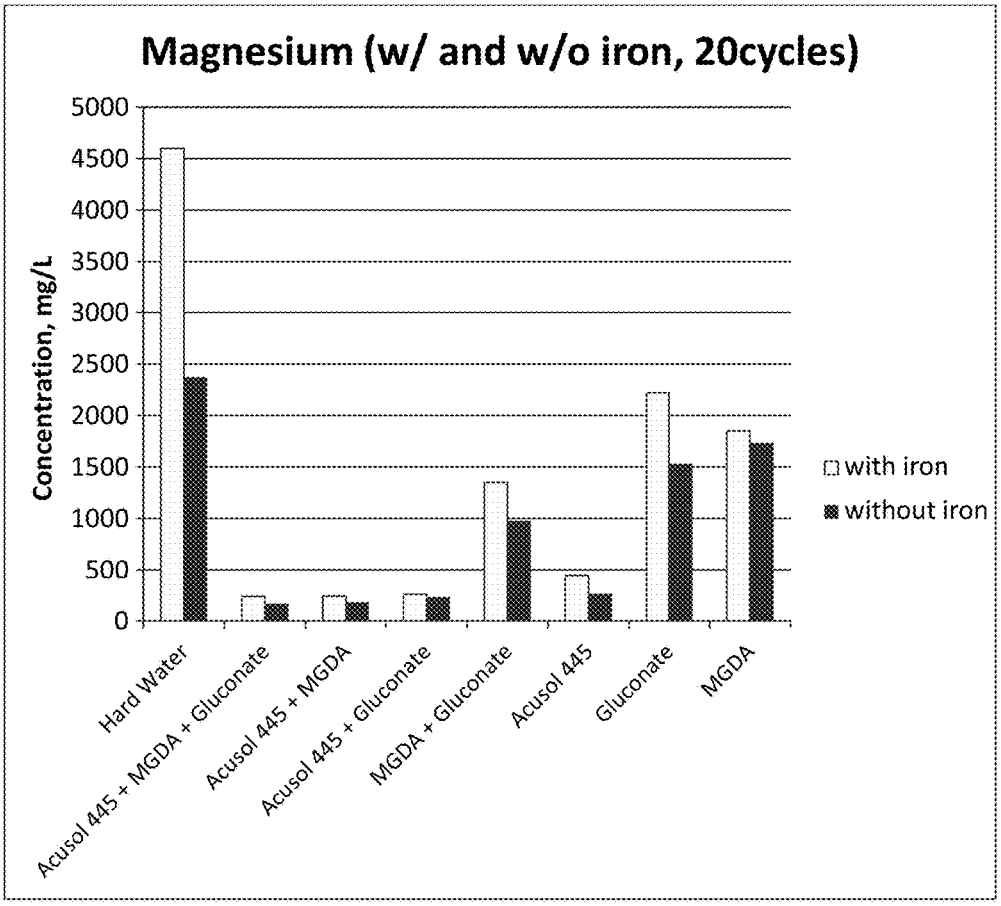
FIG. 25 shows the measurement of concentration of magnesium (mg/L)—with and without iron contaminants—using various polymers and chelant conditions to assess impact of contaminated water and/or soil sources.

FIG. 25 shows the measurement of concentration of magnesium (mg/L) deposits on the substrat—with and without iron contaminants—using various polymers and chelant conditions to assess impact of contaminated water and/or soil sources.

Figure 26:
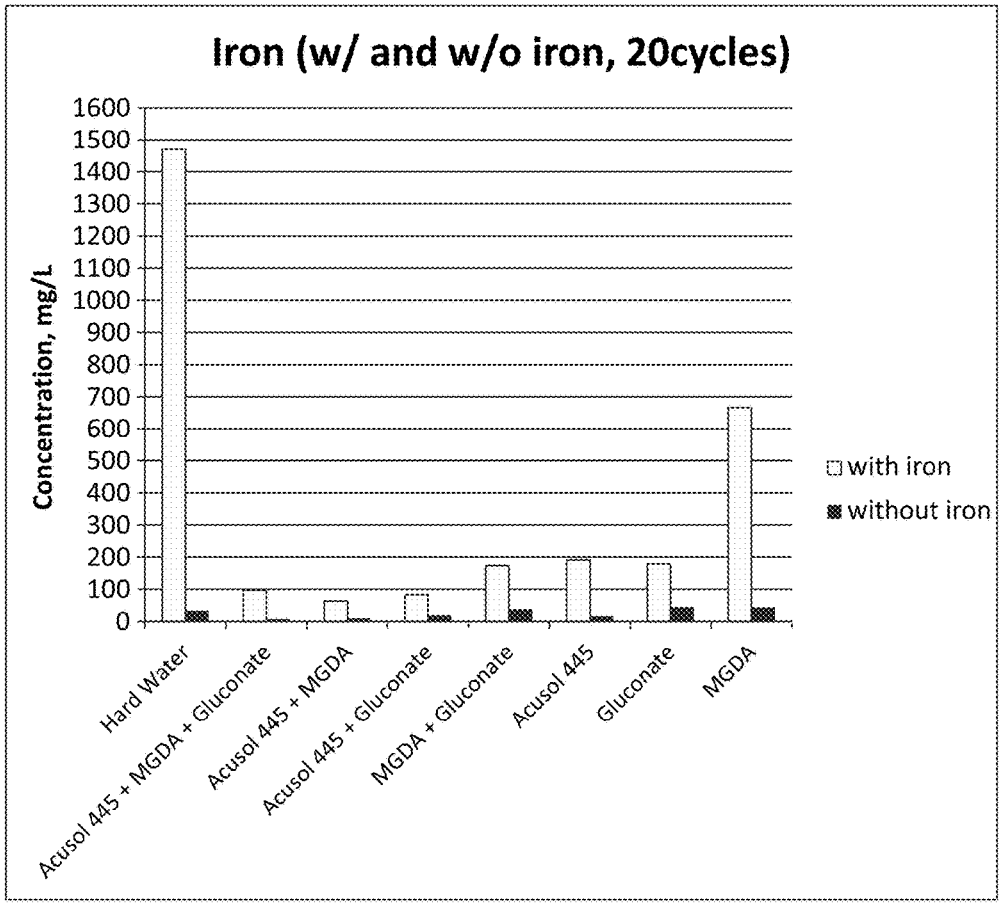
FIG. 26 shows the measurement of concentration of iron (mg/L)—with and without iron contaminants—using various polymers and chelant conditions to assess impact of contaminated water and/or soil sources.
Figure 27:
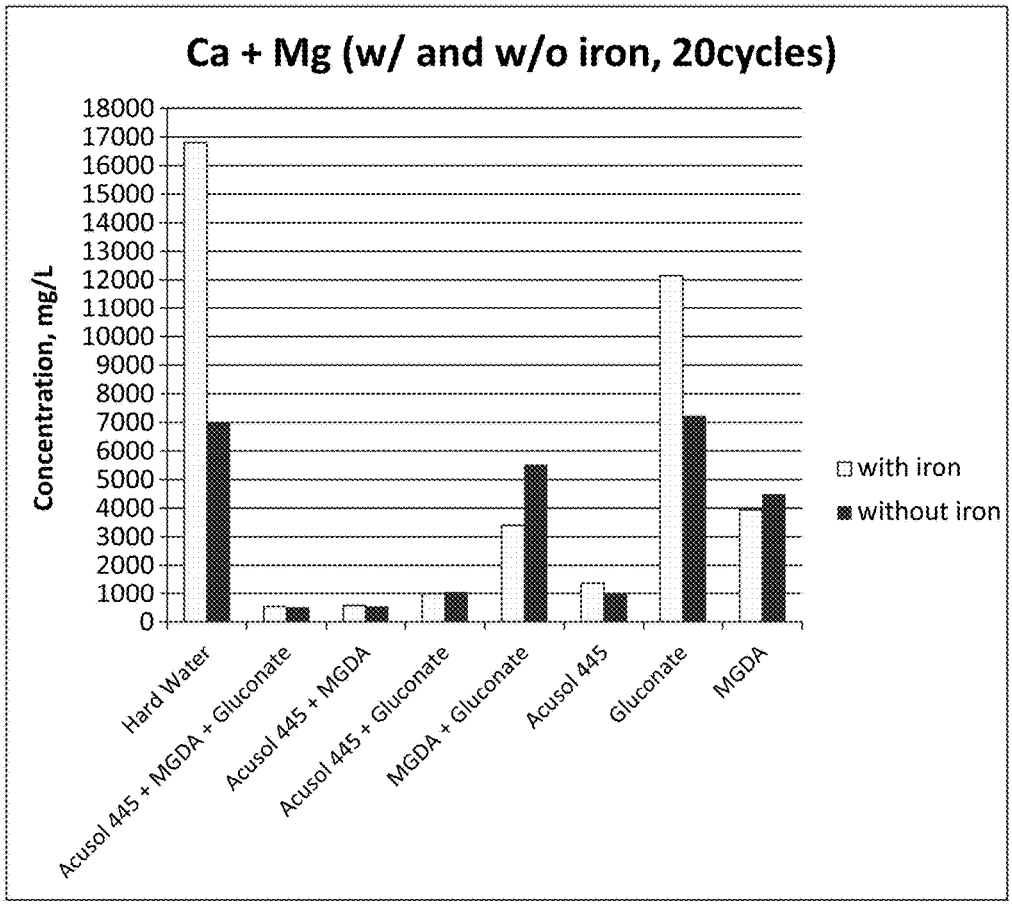
FIG. 27 shows the measurement of concentration of calcium and magnesium (mg/L)—with and without iron contaminants—using various polymers and chelant conditions to assess impact of contaminated water and/or soil sources.

FIG. 26 shows the measurement of concentration of iron (mg/L) deposits on the substrate—with and without iron contaminants—using various polymers and chelant conditions to assess impact of contaminated water and/or soil sources.

FIG. 25 shows the measurement of concentration of calcium and magnesium (mg/L) deposits on the substrate—with and without iron contaminants—using various polymers and chelant conditions to assess impact of contaminated water and/or soil sources.

The results shown here confirm the iron contaminants negatively impact the yellowness scores (and correspondingly the whiteness scores) of laundry substrates. The calcium and magnesium (alkaline earth metals resulting from water hardness) deposits impact the whiteness scores of laundry substrates because they cause greying of the substrates.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. A method for treating laundry comprising:

contacting the laundry with a laundry additive composition comprising:

a) a gluconate chelant;

b) at least one aminocarboxylate or salt thereof, wherein the at least one aminocarboxylate or salt thereof comprises methyl glycine diacetic acid and/or diethylenetriaminepentaacetic acid;

c) at least about 16 wt-% of a carboxylate polymer selected from the group consisting of a polyacrylate polymer, a polyacrylic acid, a polymaleic acid, salt thereof, or combination thereof, wherein the ratio of the gluconate chelant to the carboxylate polymer is from about 1:1 to about 3:1; and d) water, wherein:

i) the composition is substantially phosphorous-free;

ii) the contacting between the laundry additive and the laundry occurs before a bleaching step or together with a bleaching step; and iii) the laundry additive composition controls transition metal contaminants throughout the laundry process under alkaline to acid pH conditions and optionally in the presence of oxidizers.

2. The method of claim 1, wherein the laundry process comprises an initial wash process utilizing transition metal contaminated water supplied to the washer and/or transition metal contaminated soils or laundry supplied to the washer.

3. The method of claim 1, wherein the laundry process comprises a steaming or direct steam injection contaminated with transition metals to heat waters utilized in the laundry process.

4. The method of claim 1, wherein the gluconate chelant is a gluconate salt.

5. The method of claim 1, wherein the dosing of the laundry additive conditioning composition is provided at a rate of: (a) about 0.5 fluid ounces to about 30 fluid ounces, (b) about 3 fluid ounces to about 30 fluid ounces per 100 pounds of linen, or (c) at a rate to control at least 0.1 ppm transition metals in the laundry process.

6. The method of claim 1, wherein the dosing of the laundry additive composition is provided at a rate of about 0.5 to about 5 grams/L of solution of the water conditioning composition, and wherein the composition comprises from about 0.08 to about 0.8 grams/L gluconate chelant.

7. The method of claim 1, wherein the laundry additive composition is dosed into the washing machine, dosed into a steam receiving side of a steam injection heated process within the laundry process, and/or dosed into a water reuse or recycle storage container or output line.

8. The method of claim 1, comprising an initial step of measuring iron concentration in a water source or input to the laundry process.

9. The method of claim 1, wherein the contacting of the laundry additive composition is: before an oxidizing step in the laundry process; and/or simultaneous with an alkaline detergent wash step in the laundry process.

10. The method of claim 1, wherein the laundry additive composition reduces iron contaminant deposits in the laundry process to less than about 35 ppm, and reduces water hardness metal ion deposits to less than about 300 ppm.

11. A laundry additive composition comprising:

a) a gluconate chelant;

b) at least one aminocarboxylate or salt thereof, wherein the at least one aminocarboxylate or salt thereof comprises methyl glycine diacetic acid and/or diethylenetriaminepentaacetic add;

c) at least about 16 wt-% of a carboxylate polymer selected from the group consisting of a polyacrylate polymer, a polyacrylic add, a polymaleic acid, salt thereof, or combination thereof, wherein the ratio of the gluconate chelant to the carboxylate polymer is from about 1:1 to about 3:1; and d) water, wherein the composition is substantially phosphorous-free.

12. The composition of claim 11, wherein the composition is phosphorous-free.

13. The composition of claim 11, wherein the gluconate chelant is sodium gluconate or gluconic acid.

14. The composition of claim 11, wherein the at least one aminocarboxylate comprises from about 0.1 wt-% to about 10 wt-% of the composition, the carboxylate polymer comprises from 16 wt-% to about 30 wt-% of the composition, and water comprises at least about 20 wt-% of the liquid composition.

15. The composition of claim 11, further comprising at least one additional functional ingredient.

16. The composition of claim 11, wherein the composition is free of surfactants.

* * * * *